US006988956B2

(12) United States Patent
Cover et al.

(10) Patent No.: US 6,988,956 B2
(45) Date of Patent: Jan. 24, 2006

(54) ADJUSTABLE GOLF CLUB

(75) Inventors: Brian M. Cover, Scottsdale, AZ (US); William J. Shildmyer, II, Mesa, AZ (US)

(73) Assignee: SC2, Inc., Scottsdale, AZ (US)

( * ) Notice: Subject to any disclaimer, the term of this patent is extended or adjusted under 35 U.S.C. 154(b) by 0 days.

(21) Appl. No.: 11/064,243

(22) Filed: Feb. 22, 2005

(65) Prior Publication Data

US 2005/0227780 A1 Oct. 13, 2005

Related U.S. Application Data

(63) Continuation-in-part of application No. 10/948,631, filed on Sep. 22, 2004, which is a continuation-in-part of application No. 10/823,207, filed on Apr. 13, 2004.

(51) Int. Cl.
*A63B 69/36* (2006.01)
*A63B 53/04* (2006.01)

(52) U.S. Cl. ..... 473/244; 473/245; 473/251; 473/334; 473/340; 473/341; 473/313

(58) Field of Classification Search ..... 473/241–248, 473/340–341, 334–339, 313, 251
See application file for complete search history.

(56) References Cited

U.S. PATENT DOCUMENTS 1,610,802 A 12/1926 McNair
2,155,830 A 4/1939 Howard
2,530,446 A 11/1950 Beardsley
2,652,256 A * 9/1953 Thomas ..... 473/333
3,220,733 A 11/1965 Saleesby
D209,524 S 12/1967 Mader
3,516,674 A 6/1970 Scarborough
4,506,888 A 3/1985 Nardozzi, Jr.
4,736,951 A 4/1988 Grant
4,895,371 A 1/1990 Bushner
4,979,744 A * 12/1990 Alcala ..... 473/341
5,230,509 A 7/1993 Chavez
5,292,128 A * 3/1994 Solheim ..... 473/313
5,415,399 A 5/1995 Kettelson
5,482,281 A 1/1996 Anderson
5,533,730 A 7/1996 Ruvang
5,571,053 A 11/1996 Lane
5,688,189 A 11/1997 Bland
5,749,790 A 5/1998 Van Allen, II et al.
5,769,737 A 6/1998 Holladay et al.
5,924,938 A * 7/1999 Hines ..... 473/307
5,993,324 A 11/1999 Gammil
6,001,024 A 12/1999 Van Alen, II et al.
6,015,354 A 1/2000 Ahn et al.

(Continued)

*Primary Examiner*—Sebastiano Passaniti
(74) *Attorney, Agent, or Firm*—Greenberg Traurig, LLP

(57) ABSTRACT

A golf club (e.g., driver or putter) is provided. The club includes a head. The club also includes a handle having a proximate end connected to the head and having a distal end (which may be provided with a grip). The head may include components that can be adjusted to alter (e.g., simultaneously and/or independently) the position of the proximate end of the handle on the head and to alter the head weight balance and/or orientation.

6 Claims, 32 Drawing Sheets

U.S. PATENT DOCUMENTS

| | | | | |
|---|---|---|---|---|
| 6,019,686 | A | 2/2000 | Gray | |
| D443,664 | S | 6/2001 | Olson | |
| 6,379,264 | B1 | 4/2002 | Forzano | |
| 6,422,950 | B1 * | 7/2002 | Whitlam | 473/313 |
| 6,450,894 | B1 | 9/2002 | Sun et al. | |
| 6,514,154 | B1 | 2/2003 | Finn | |
| 6,692,371 | B2 | 2/2004 | Berish et al. | |
| 2002/0107086 | A1 | 8/2002 | Cameron | |
| 2002/0115502 | A1 | 8/2002 | Fountain | |
| 2003/0083149 | A1 | 5/2003 | Scarpa et al. | |
| 2003/0195053 | A1 | 10/2003 | Cameron | |

* cited by examiner

ADJUSTABLE GOLF CLUB

CROSS-REFERENCE TO RELATED APPLICATIONS

This application is a continuation in part of U.S. application Ser. No. 10/948,631, filed Sep. 22, 2004, which is a continuation in part of U.S. application Ser. No. 10/823,207, filed Apr. 13, 2004.

FIELD OF THE INVENTION

Various embodiments of the present invention relate to golf clubs (e.g. drivers or putters).

In this regard, one embodiment of the present invention relates to a golf club that facilitates the adjustment of the heel-to-toe and/or front-to-back weight distribution of the club.

Another embodiment of the present invention relates to a golf club that permits adjustment of the orientation of the striking face of the club with respect to a golf ball when the ball is being addressed with and struck by the club.

Another embodiment of the present invention relates to a golf club that permits adjustment of club balancing between a face-balanced configuration and a toe-weighted configuration (including any number of essentially infinite intermediate configurations between the two).

BACKGROUND OF THE INVENTION

Both the heel-to-toe and front-to-back weight distribution in the head of a golf putter and the orientation of the putter ball-striking face contribute to the functioning of the putter. If the putter ball-striking face has a slight backward tilt (away from the ball), the face tends to lift the golf ball when the ball is struck. Providing a putter with a ball-striking face that has a backward tilt is described as "adding loft" to the putter. If the putter ball-striking face has a slight forward tilt (towards the ball), the face tends to push the golf ball into the green when the ball is struck. Providing a putter with a ball-striking face that has a forward tilt is described as "delofting" the putter.

The head of each putter has a particular balance orientation. In one example (which example is intended to be illustrative and not restrictive), the balance orientation of a putter head may be determined by finding a point on the shaft at which the shaft will assume a generally horizontal orientation when balanced on an object (e.g. on a fingertip). When the putter is so balanced on the fingertip of a golfer with the club shaft in a generally horizontal orientation, the putter head will typically assume one of the three basic putter head balance orientations.

The first putter head balance orientation is the "face-balanced orientation". When the putter head is in the face-balanced orientation, the striking face of the putter is horizontally oriented (i.e., is parallel to the ground) and faces upwardly toward the sky. In a face-balanced putter, the putter shaft location with respect to the head typically, but not always, points toward the center of the putter head.

The second putter head balance orientation is the "toe-weighted" orientation. When the putter head is in the toe-weighted orientation, the toe of the putter hangs straight down, the heel of the putter points upwardly toward the sky, and the striking face of the putter is vertically oriented (i.e., is perpendicular to the ground). In a toe-weighted putter, the shaft typically is attached to the head at the heel.

The third putter head balance orientation is the "intermediate" orientation. When the putter head is in the intermediate orientation, it is oriented in a position between the face-balanced orientation and the toe-weighted orientation. The striking face of the putter head is canted, and is neither horizontally nor vertically oriented. In this regard, when a putter head is in the face-balanced orientation, the ball striking face is at an angle of essentially zero degrees with respect to the horizontal. On the other hand, when a putter head is in the toe-weighted orientation, the ball striking face of the putter is at an angle of essentially ninety degrees with respect to the horizontal. Thus, when a putter head has an intermediate orientation, the ball striking face of the putter is at an angle to the horizontal in the range of slightly more than zero degrees to slightly less than ninety degrees (typically an angle of twenty to eighty degrees with respect to the horizontal).

One popular style of putting is indicated in FIG. 24 and is called the pendulum style. In FIG. 24, dashed line 180 indicates the line of travel of the golf ball after being struck by the ball striking face of a putter 210 at point 184. When pendulum style putting is used, the putter head travels along an essentially straight line 181, 182, or 183 during the back stroke and follow through.

Another popular style of putting is indicated in FIG. 25 and is called the open-and-closed stroke. In FIG. 25, dashed line 185 indicates the line of travel of the golf ball after being struck by the ball striking face of a putter 211 at point 188. When the open-and-closed stroke is used, the putter head travels along an essentially curved path 186, 187, and opens on the back stroke, squares up to the ball at the contact point 188, and closes on the follow through. The severity of the arc in the curved path varies according to the golfer.

It is generally agreed that a putter with a head that has a face-balanced orientation facilitates a pendulum style putting stroke, and that a putter with a head that has an intermediate orientation or toe-weighted orientation facilitates the open-and-closed putter stroke.

BRIEF DESCRIPTION OF THE DRAWINGS

(FIG. 34 is a shaded solid model type rear view of the putter head shown from a first angle, FIG. 35 is a shaded solid model type rear view of the putter head shown from a second angle, FIG. 36 is an un-shaded type rear view of the putter head shown from the first angle of FIG. 34 and FIG. 37 is an un-shaded type rear view of the putter head shown from the second angle of FIG. 35).

Figure 1:
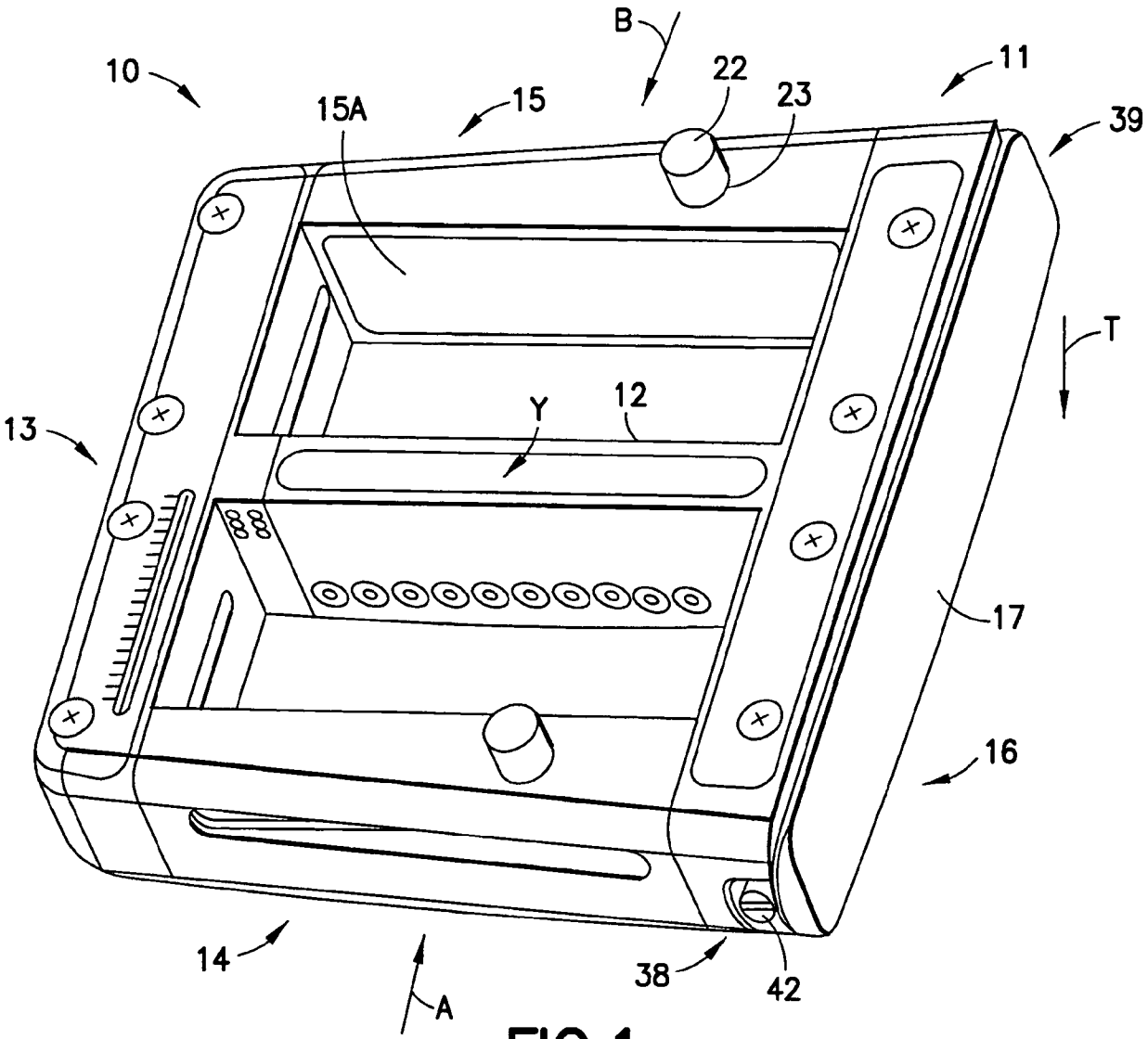
FIG. 1 is a perspective top view of the head of a golf putter according to an embodiment of the present invention.

Among those benefits and improvements that have been disclosed, other objects and advantages of this invention will become apparent from the following description taken in conjunction with the accompanying figures. The figures constitute a part of this specification and include illustrative embodiments of the present invention and illustrate various objects and features thereof.

DETAILED DESCRIPTION OF THE INVENTION

Detailed embodiments of the present invention are disclosed herein; however, it is to be understood that the disclosed embodiments are merely illustrative of the invention that may be embodied in various forms. In addition, each of the examples given in connection with the various embodiments of the invention are intended to be illustrative, and not restrictive. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

Briefly, in accordance with one embodiment of the present invention, a putter may include a head and a shaft (the shaft may include a proximate end attached to the head and a distal end including a grip). The head may include a forward portion including a face for striking a golf ball and a wing portion extending rearwardly from the forward portion and movable between at least two operative positions (e.g., a first operative position and a second operative position laterally displaced along the forward portion in a direction outwardly away from the proximate end of the shaft to alter the heel-to-toe weight distribution of the putter).

In another embodiment of the invention a golf putter may include a head and the head may include: a forward portion including a face for striking a golf ball and a wing portion extending rearwardly from the forward portion and movable between at least two operative positions (e.g., a first operative position and a second operative position laterally displaced along the forward portion to alter the heel-to-toe weight distribution of the putter). The putter may also include a shaft with a proximate end attached to the wing portion and a distal end including a grip.

In still another embodiment of the present invention a golf putter may include a head and a shaft. The shaft may have a proximate end attached to the head and may have a distal end. The distal end may include a grip. The proximate end may be movable between at least two operative positions on the head.

In still another embodiment of the present invention a golf putter may include a head and a shaft with a proximate end attached to the head and a distal end, the distal end including a grip. The head may include a ball striking portion with a back, a top, and a ball striking face; and at least one balance adjusting portion slidably mounted on the ball striking portion and slidable between at least two operative positions (e.g., a first operative position in which the putter has a face-balanced orientation and a second operative position slidably displaced from the first operative position in which the putter has a toe-weighted orientation).

In still another embodiment of the present invention a golf putter may include a head and a shaft with a proximate end attached to the head and a distal end, the distal end including a grip. The head may include a ball striking portion including a back, a top, and a ball striking face; and at least one balance adjusting portion slidably mounted on the ball striking portion and slidable between at least two operative positions (e.g., a first operative position in which the putter has a face-balanced orientation, and a second operative position slidably displaced from the first operative position in which the putter has an intermediate orientation).

In still another embodiment of the present invention a golf putter may include a head and a shaft with a proximate end attached to the head and a distal end, the distal end including a grip. The head may include a ball striking portion including a back, a top, and a ball striking face and at least one balance adjusting portion slidably mounted on the ball striking portion and slidable between at least two operative positions (e.g., a first operative position in which the putter has a toe-weighted orientation, and a second operative position slidably displaced from the first operative position in which the putter has an intermediate orientation).

In still another embodiment of the present invention a golf putter allows a golfer to adjust readily both the heel-to-toe weight distribution and the top-to-bottom cant or loft of the putter face, as well as to adjust the putter head balance orientation.

In still another embodiment of the present invention a golf putter permits the weight distribution of the putter head to be adjusted by altering the location at which the club shaft is connected to the putter head.

In still another embodiment of the present invention a golf putter permits the weight distribution of the putter head to be altered by symmetrically (or independently) adjusting the relative position of opposing putter structural components.

In still another embodiment of the present invention a golf putter having an articulating ball-striking face is provided.

In still another embodiment of the present invention a golf putter permits the position of structural putter head components to be adjusted simultaneously or independently of the location at which the proximate end of the putter shaft is connected to the putter head.

In still another embodiment of the present invention a golf putter permits, without substantially altering the location of the center of gravity of the putter head, the location on the putter head at which the proximate end of the club shaft is attached to be adjusted.

In still another embodiment of the present invention a golf putter permits adjustment of the magnitude of the torque acting on the heel and/or toe of the putter head.

In still another embodiment of the present invention a golf putter permits the weight distribution of the putter head to be altered by adjusting putter structural components that counterpoise one another.

Figure 9:
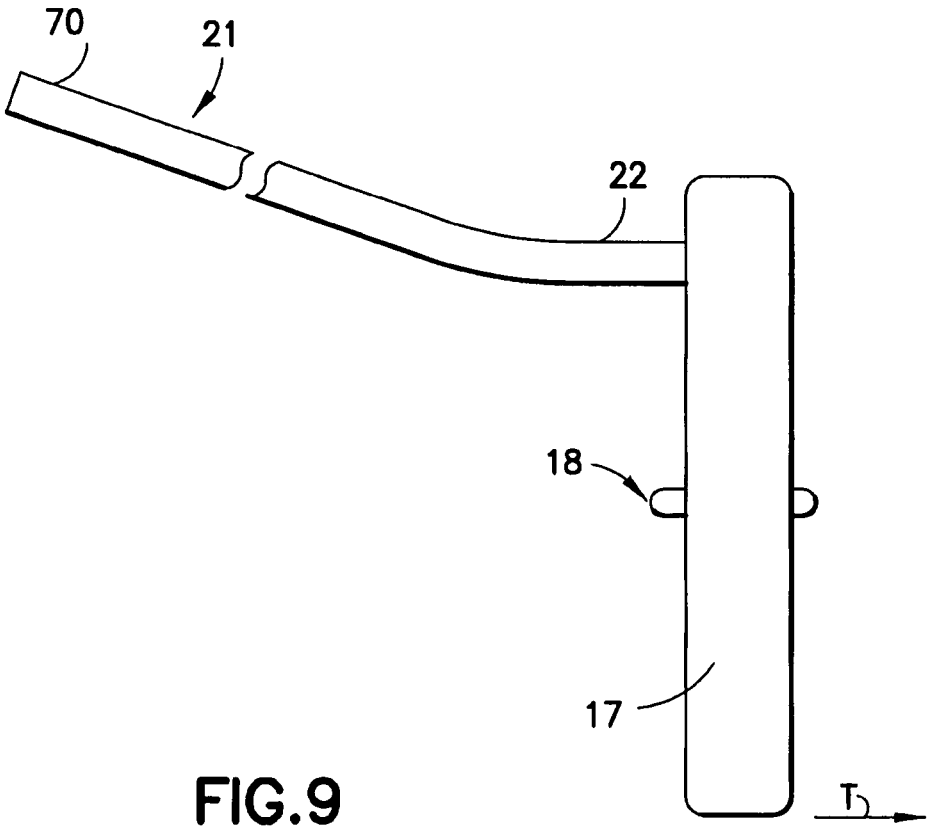
FIG. 9 is a front view of the golf putter of FIG. 8, illustrating the ball-striking face thereof.
Figure 10:
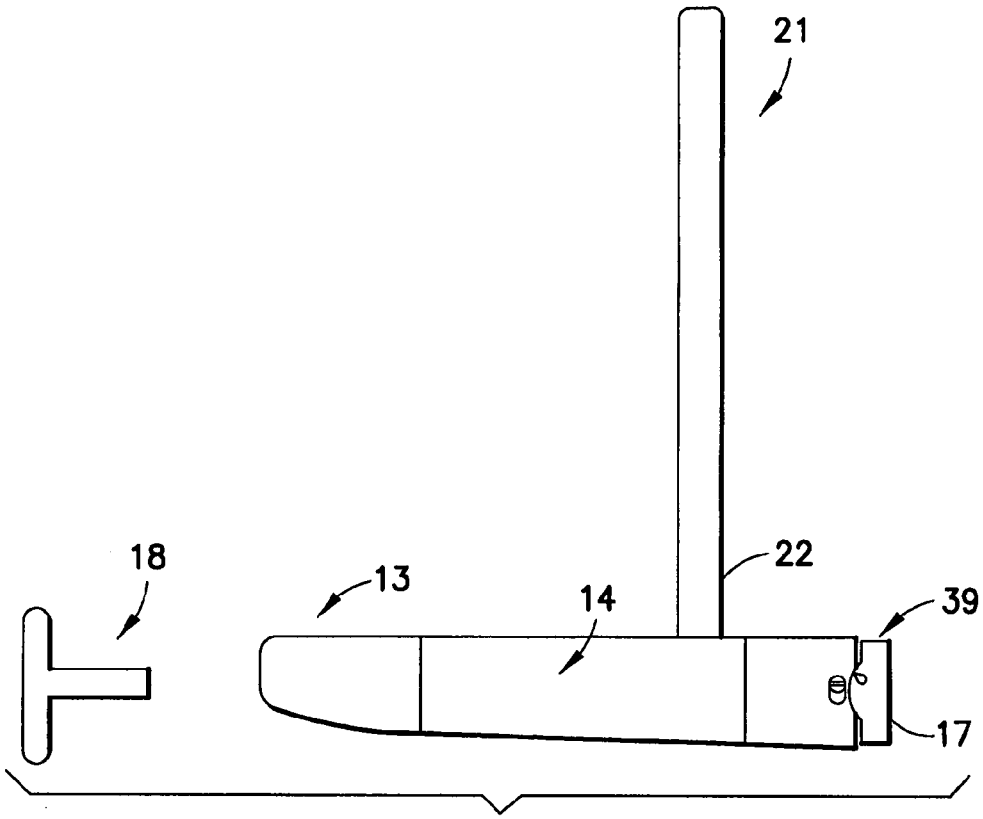
FIG. 10 is a side view of the golf putter of FIG. 8.

Turning now to the drawings, which depict various embodiments of the invention for the purpose of illustrating the practice thereof and not by way of limitation of the scope of the invention and in which like reference characters refer to corresponding elements throughout the several views, FIGS. 1 to 5 and 7 to 13 illustrate one embodiment of the golf putter of the invention, generally indicated by reference character 10. Putter 10 includes a head and a shaft 21 (see, e.g., FIGS. 9 and 10). Shaft 21 includes a proximate end 22 connected to the head and includes a distal end 70 (FIG. 9). Distal end 70 functions as a handle for the golfer to manually grasp the putter shaft. It is understood that the shape and dimension of shaft 21 can vary as desired. For example (which example is intended to be illustrative and not restrictive), shaft 21 can take on a shape and dimension comparable to conventional heel-shafted putters or can take on a shape and dimension comparable to handles found on pendulum type center-shafted putters. Shaft 21 can be moved on the putter head to the heel in the manner of a conventional heel-shafted putter. Or, shaft 21 can be moved to a location on the putter head comparable to that used in pendulum type center-shafted golf putters. Further, shaft 21 may have, relative to the head, any desired angle and/or offset (one or both of which may be adjustable).

Figure 6:
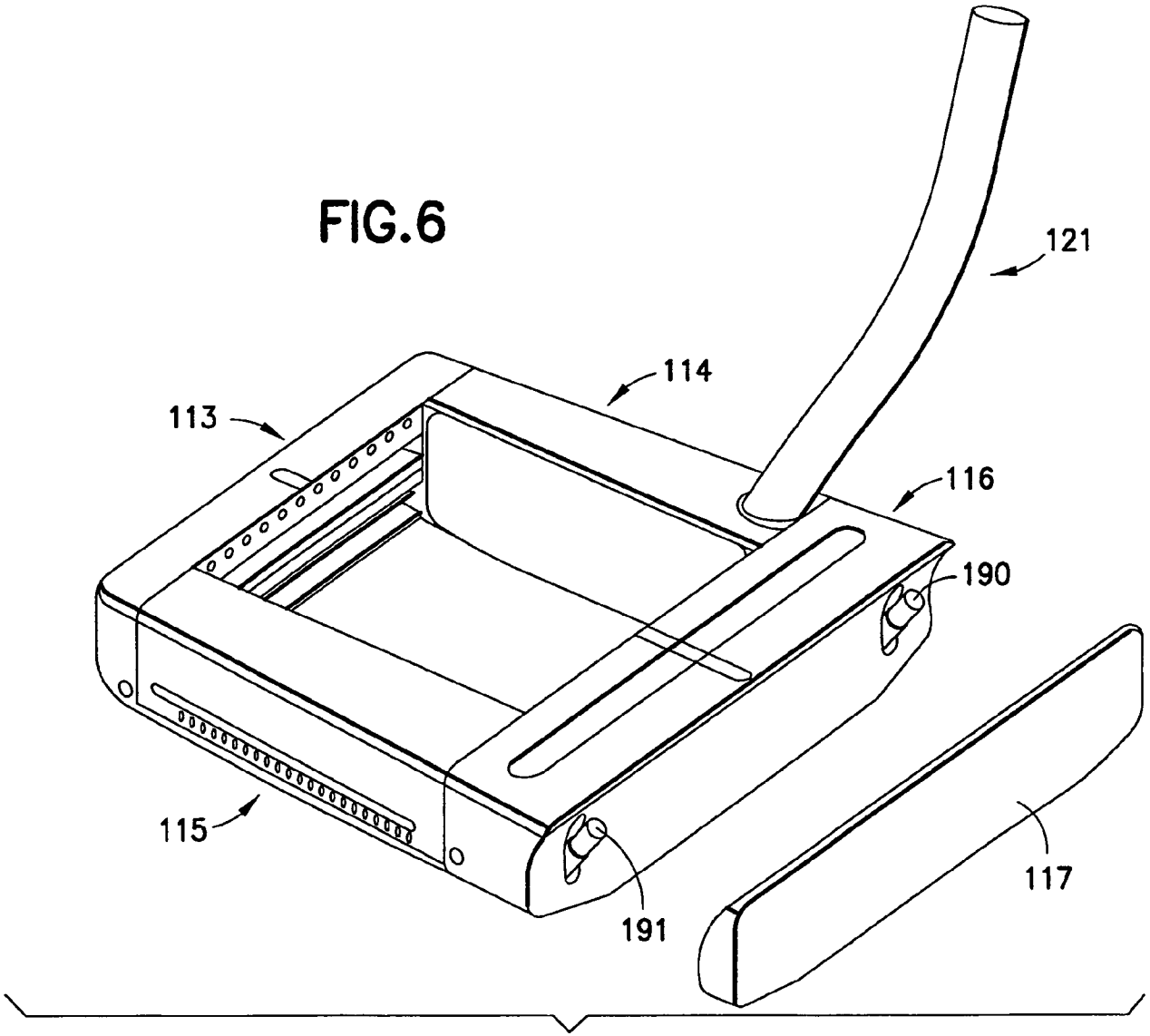
FIG. 6 is a perspective top front view of the putter of FIG. 14, illustrating construction details of the adjustable pivoting striking face of the putter.
Figure 7:
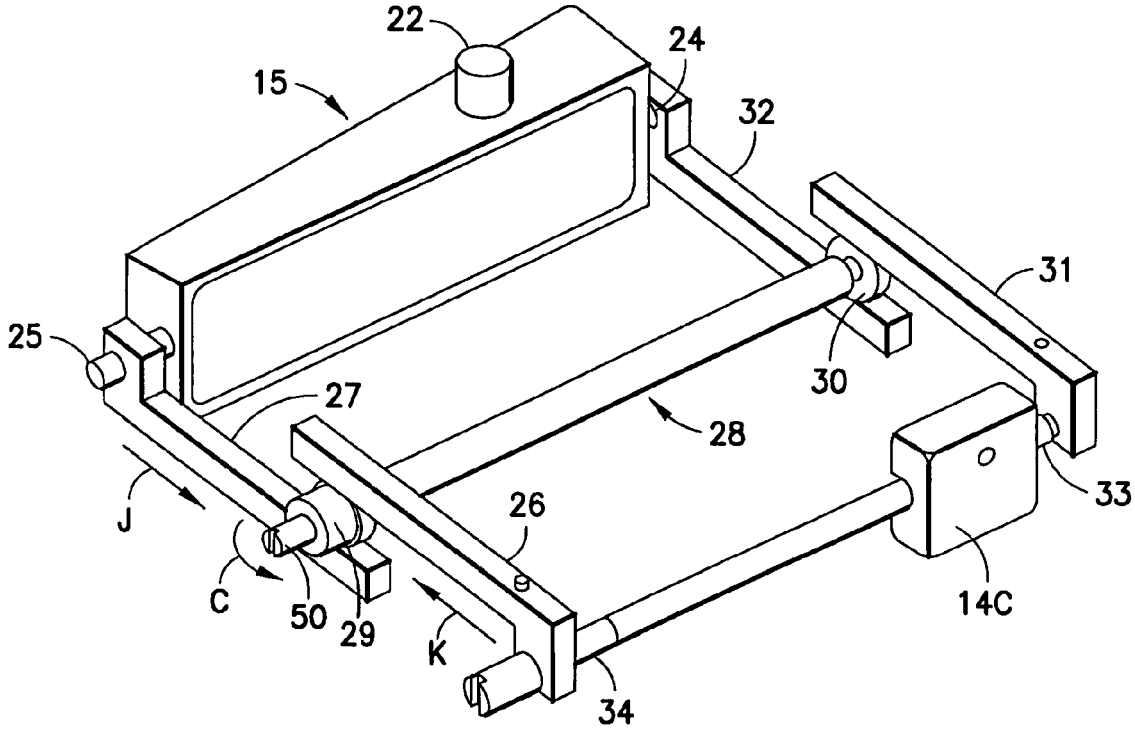
FIG. 7 is a perspective view illustrating a linkage system utilized to adjust the position of the putter wing portions.
Figure 8:
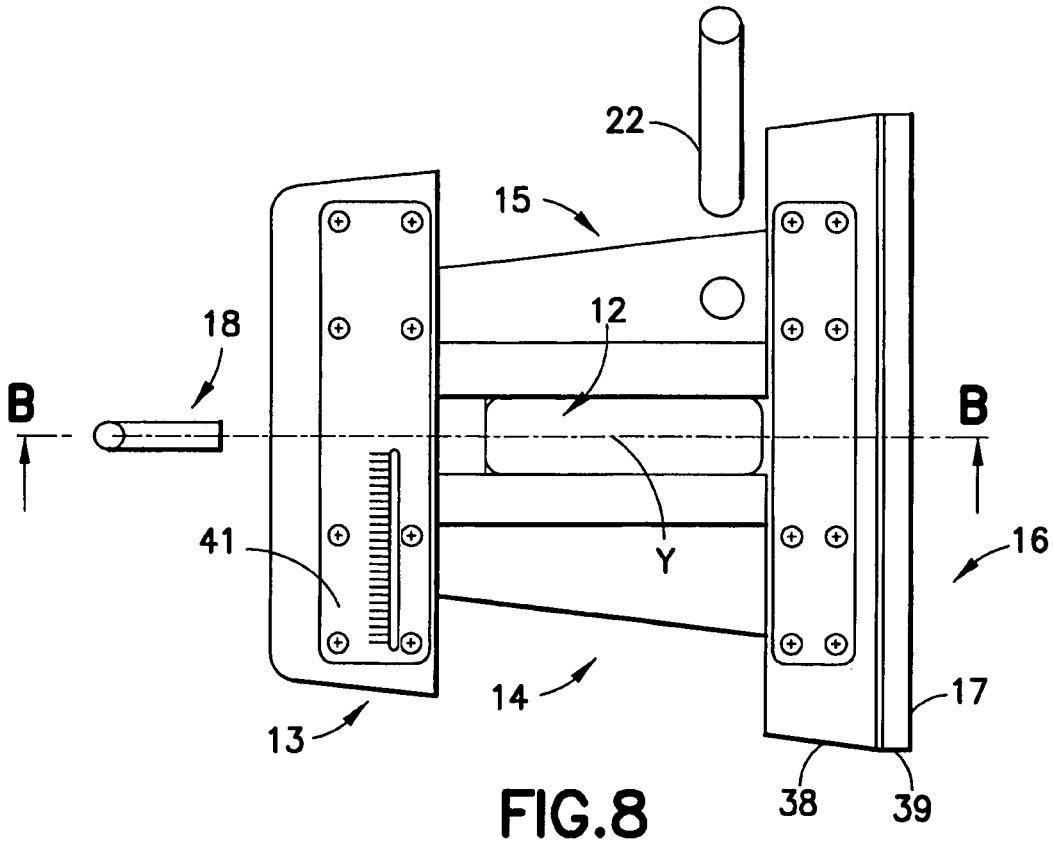
FIG. 8 is a top view of the golf putter of FIG. 1.

The head of the putter includes a front portion 16, a back portion 13, neck 12, and a pair of wing portions 14 and 15. Wing 15 includes plate 15A. Wing 14 includes plate 14A. Front portion 16 includes ball striking face 17, and, includes component 38 and component 39. Face 17 is part of component 39. Component 39 is mounted on component 38 such that component 39—and face 17—can be pivoted or moved about a horizontal axis to change the cant or loft of face 17 from top-to-bottom. Neck 12 fixedly interconnects front portion 16 and rear portion 13 such that wing portions 14 and 15 can be laterally adjusted (in and out) in the direction of arrows A and B, respectively (e.g., to alter the toe-to-heel weight distribution in the head of the putter, to alter the location of proximate end 22 with respect to the center of gravity Y (FIGS. 1 and 8) of the putter head, and/or to alter the putter head balance orientation). Of note, the center of gravity of the head of the putter 10 generally would not substantially change when the positions of wing portions 14 and 15 are adjusted to simultaneously move equal distances toward or away from neck 12. On the other hand, the center of gravity Y can change if the putter head is designed such that portion 14 moves a different distance than portion 15 toward or away from neck 12 or if the position of only portion 14 (or only portion 15) is adjusted. Moving proximate end 22 inwardly from the position shown in FIG. 1 toward neck 12 also reduces the magnitude of the torque T (FIGS. 1 and 9) acting on the toe of the club with respect to proximate end 22, i.e., moving proximate end 22 inwardly toward neck 12 causes less rotational force to be acting on proximate end 22. As used herein, the toe of a golf club head is the portion of the head that is farthest from a golfer when the golfer is addressing and striking a ball. The heel of a golf club head is the portion of the head that is closest to the golfer when the golfer is addressing and striking a ball. The putter head includes a linkage system that is not visible in FIG. 1 but that will be described below in more detail. The linkage system enables end 19 of key 18 to be inserted in an opening 20 (FIG. 3) in back portion 13 to engage the head or end 50 (FIG. 5) of a control shaft 28 (FIGS. 3, 5, 6) in the linkage system. When key 18 is then turned in the direction of arrow C, the control shaft 28 rotates simultaneously with key 18 and the linkage system simultaneously displaces wing portions 14 and 15 in the direction of arrows A and B, respectively, toward the stowed positions shown in FIG. 8. After wing portions 14 and 15 are displaced in the directions of arrows A and B from the distended positions shown in FIG. 1 to the stowed positions if FIG. 8 (or are displaced to a position intermediate the distended and stowed positions), wing portions 14 and 15 can be returned to the distended positions of FIG. 1 by rotating key 18 (and control shaft 28) in a direction opposite that of the direction indicated by arrow C.

Component 39 includes at least one shaft or screw 42 that is rotatably received by an oval aperture 53 formed in component 38. Arcuate convex surface 45 conforms to and is slidably adjusted over arcuate concave surface 44 in component 38 to adjust the cant of striking face 17 of component 38.

Figure 2:
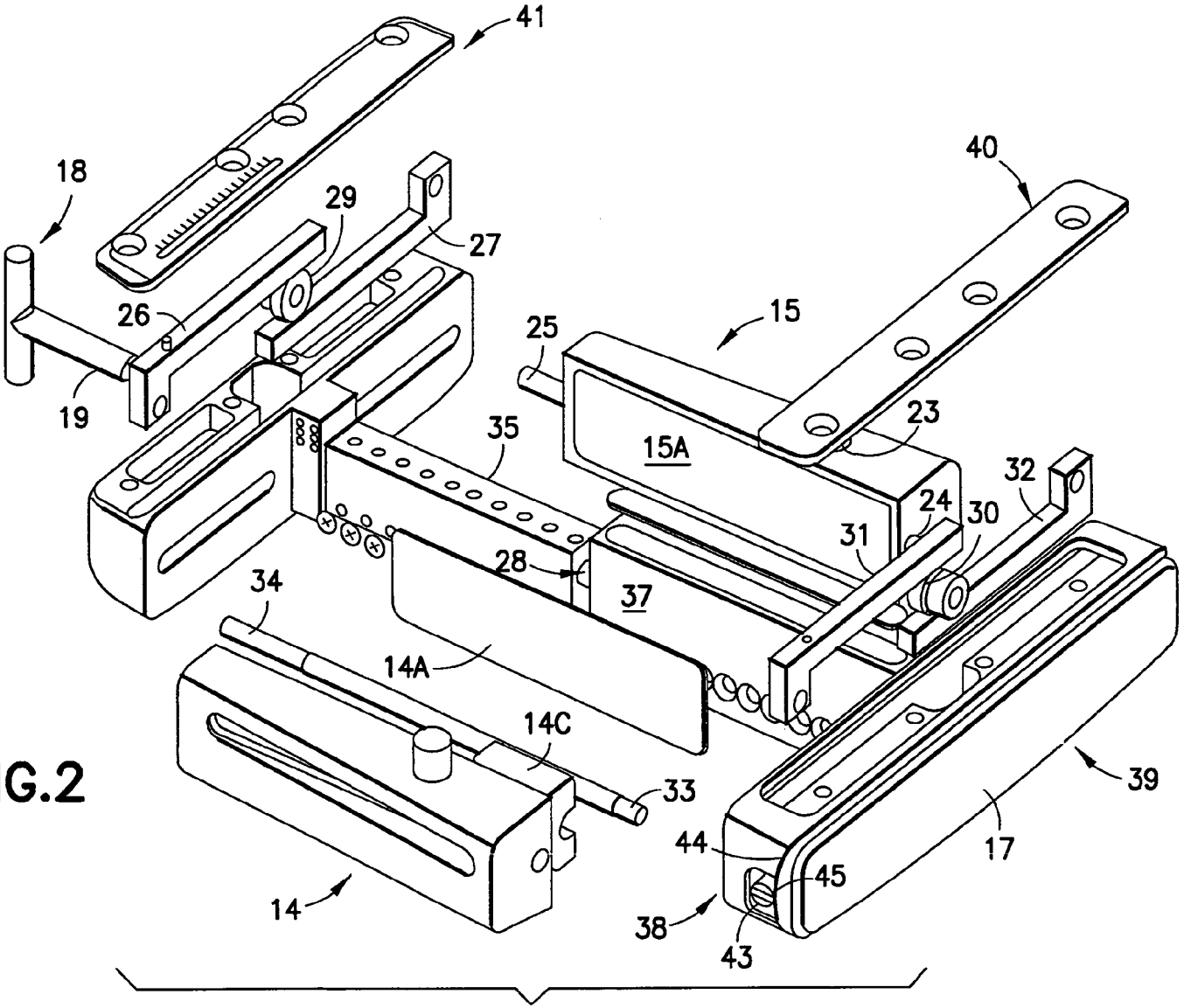
FIG. 2 is a perspective top front exploded view of the putter head of FIG. 1.
Figure 3:
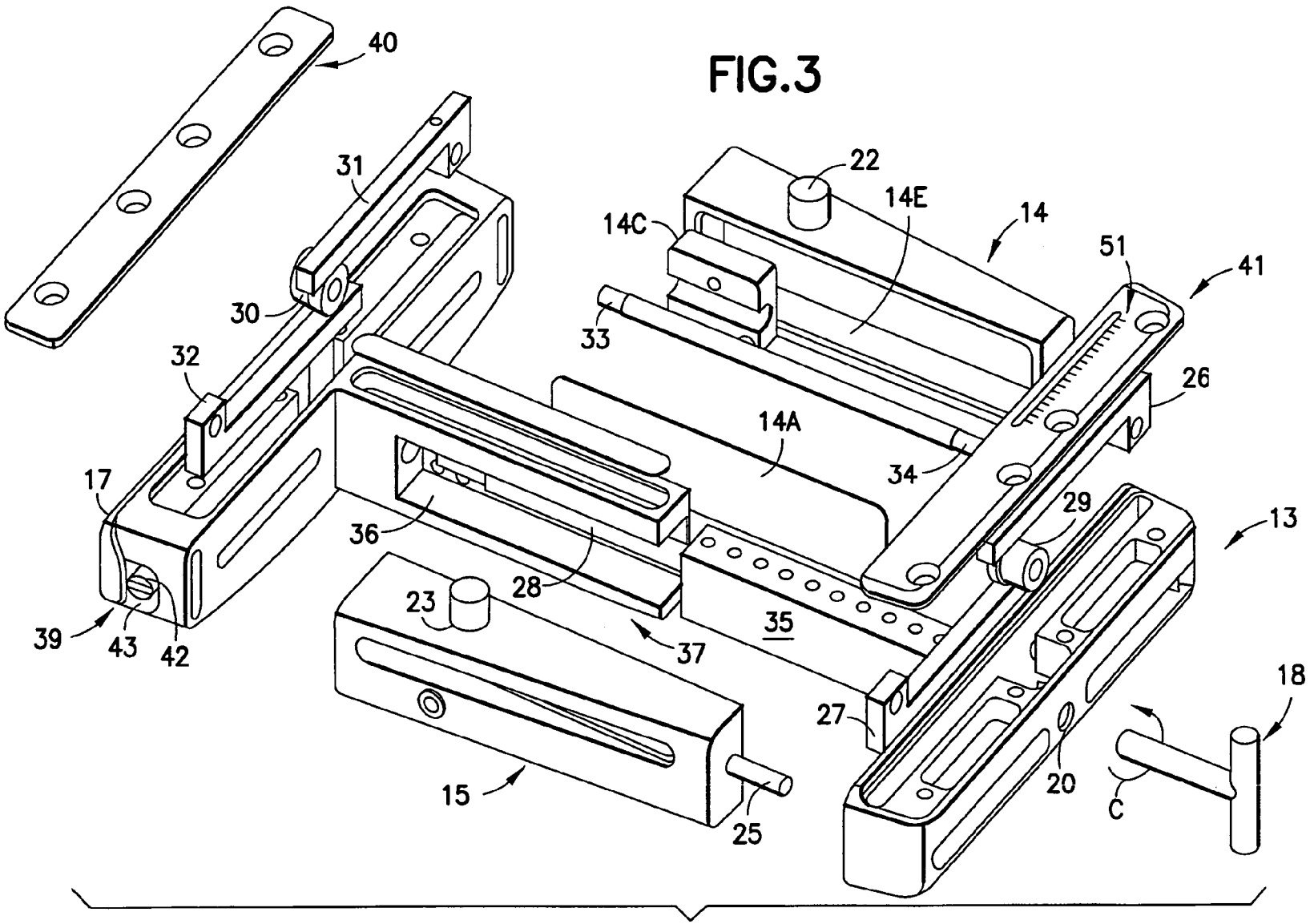
FIG. 3 is a perspective top rear exploded view of the putter head of FIG. 1 illustrating further construction details thereof.
Figure 4:
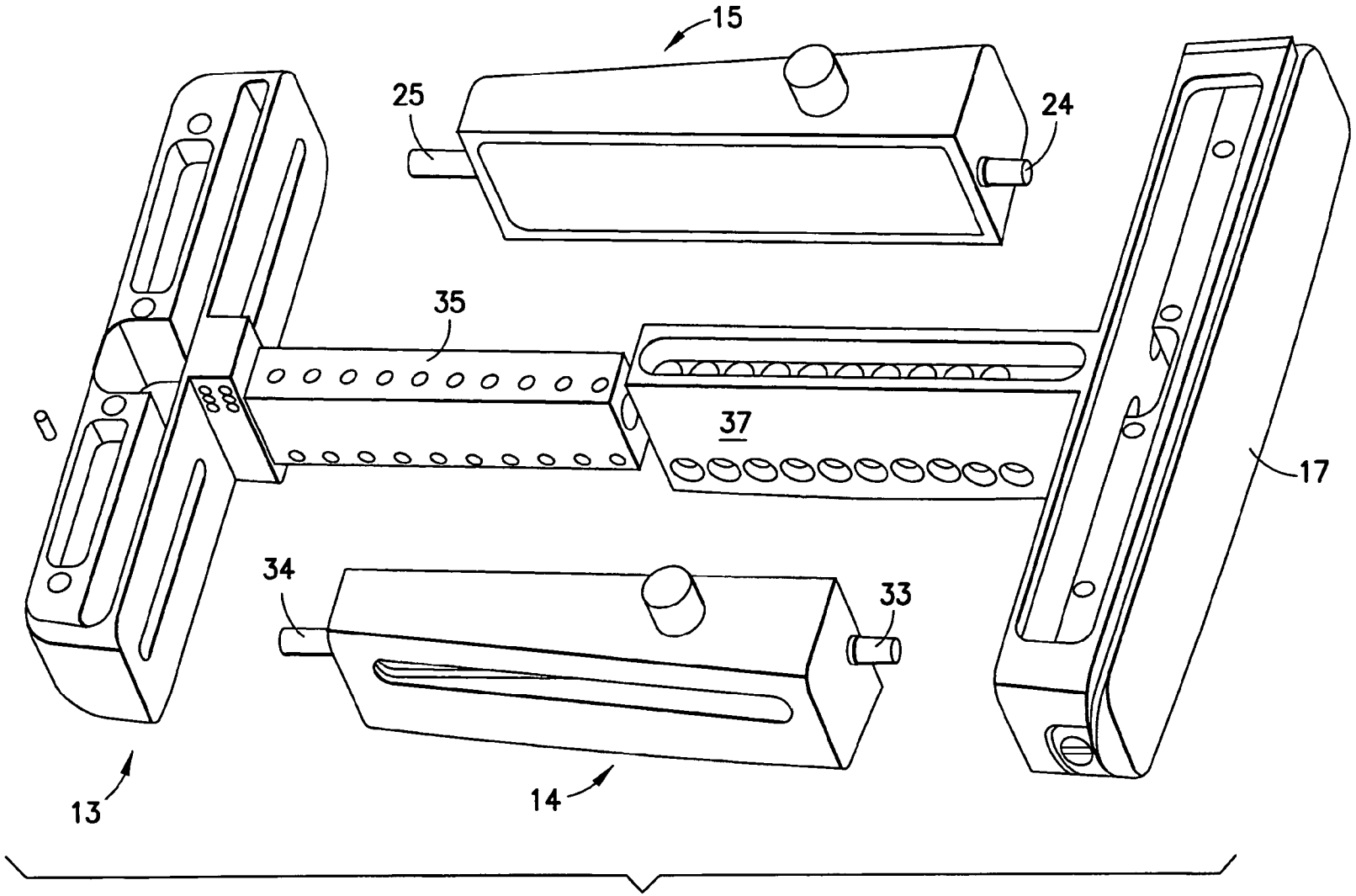
FIG. 4 is a perspective top front exploded view of the putter head of FIG. 3 illustrating particular components thereof.
Figure 5:
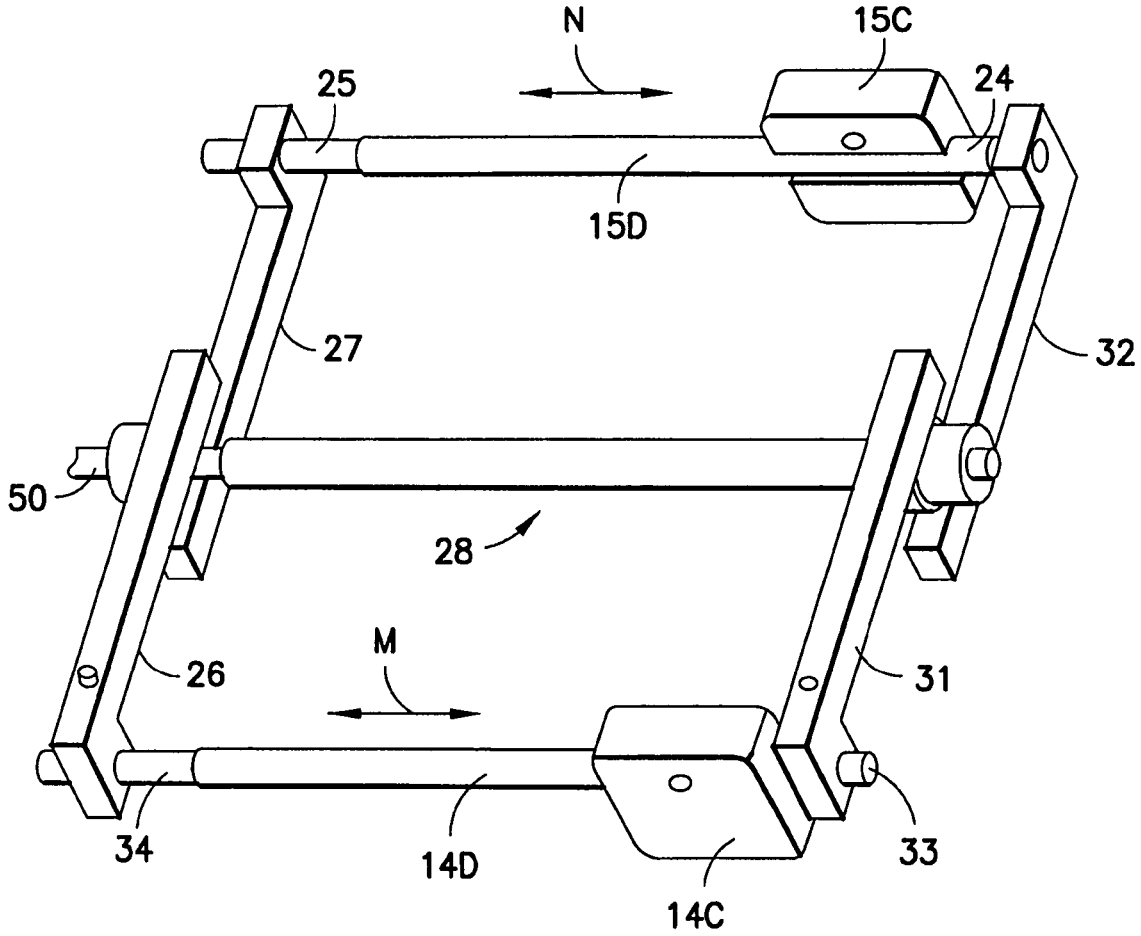
FIG. 5 is a perspective view illustrating a linkage system used to adjust the position of the putter wings.

FIGS. 2 and 3 illustrate various components of putter 10 in more detail. When the putter head is assembled, plates 40 and 41 cover and conceal openings formed in component 38 and in back portion 13, respectively.

As earlier noted, the linkage system in the putter head includes control shaft 28. Shaft 28 includes a roller 29 at one end and a roller 30 at its other end. As is illustrated in FIG.

7, roller 29 contacts arms 26 and 27. Pin 25 connects arm 27 to wing 15. Wing 14 (not shown in FIG. 7) is connected to arm 26 by pin 34. In like fashion, roller 30 on the other end of control shaft 28 contacts arms 31 and 32. The distal end of arm 31 is connected to wing portion 14 by pin 33. The distal end of arm 32 is connected to wing portion 15 by pin 24. When wing portions 14 and 15 are each in the distended position in FIG. 1, turning control shaft 28 in the direction of arrow C with key 18 displaces arms 27 and 32 in the direction of arrow J, and displaces arms 26 and 31 in the direction of arrow K. Such displacement of arms 26, 27, 31, 32 draws wing portions 14 and 15 inwardly in the direction of arrows A and B, respectively, toward the stowed position of FIG. 8. Key 18 and shaft 28 can be turned an amount sufficient to draw wing portions 14 and 15 inwardly until they contact neck 12. Or, key 18 can be turned an amount sufficient to draw wing portions 14 and 15 inwardly in the directions of arrows A and B, respectively, but not to draw wing portions 14 and 15 inwardly in the directions of arrows A and B a distance sufficient for portions 14 and 15 to contact neck 12 in the stowed position of FIG. 8.

As is illustrated (e.g., in FIGS. 5 and 7), weight 14C is slidably mounted on shaft 14D. Weight 14C is slidably moved along shaft 14D in the directions indicated by arrows M to selected positions along shaft 14D. If desired, weight 14C can include a set screw or other means to secure and release weight 14C from a position along shaft 14D. Weight 14C and shaft 14D are housed in opening 14E (FIG. 3) formed in wing 14.

Weight 15C is slidably mounted on shaft 15D. Weight 15C is slidably moved along shaft 15D in the directions indicated by arrows N to selected positions along shaft 15D. If desired, weight 15C can include a set screw or other means to secure and release weight 15C from a position along shaft 15D. Weight 15C and shaft 15D are housed in an opening that is formed in wing 15 and this is comparable in shape and dimension to opening 14E.

The roller 29, 30 to arm 26, 27, 31, 32 linkage system illustrated, for example, in FIGS. 2, 3, 4, 5, and 7 can be modified by forming gear teeth on the rollers and arms to produce a rack and pinion type structure, in which case rollers 29, and 30 each would be a toothed gear and the arms would each include a horizontally oriented row of gear teeth that would engage toothed gears 29 and 30. Further, any desired linkage system can be used as long as the position of at least one wing 14, 15 can be laterally adjusted in the manner described with respect to front portion 16 and face 17.

In FIG. 3, neck 12 includes an orthogonal member 35 that intercalates with U-shaped component 37 by fitting and being secured in U-shaped opening 36.

Figure 11:
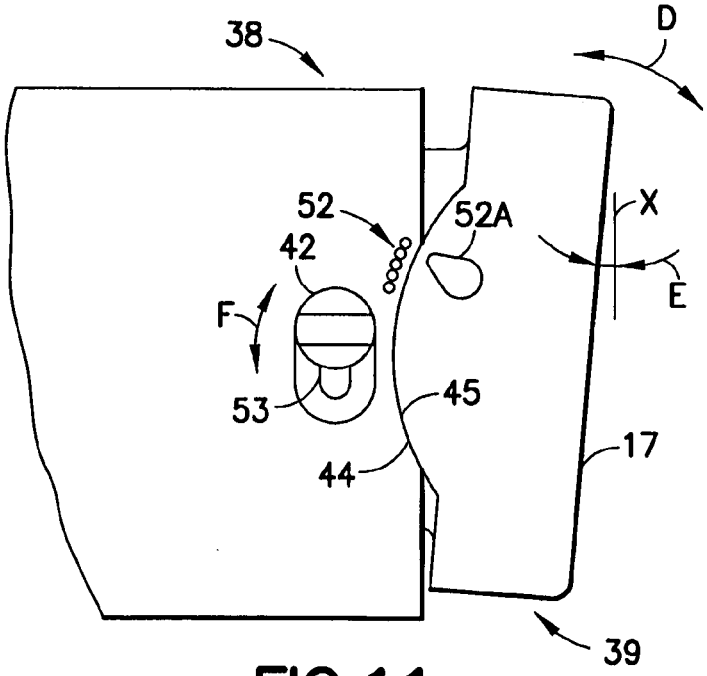
FIG. 11 is an enlarged side view of the golf putter of FIG. 1, illustrating the articulating ball-striking face thereof.
Figure 12:
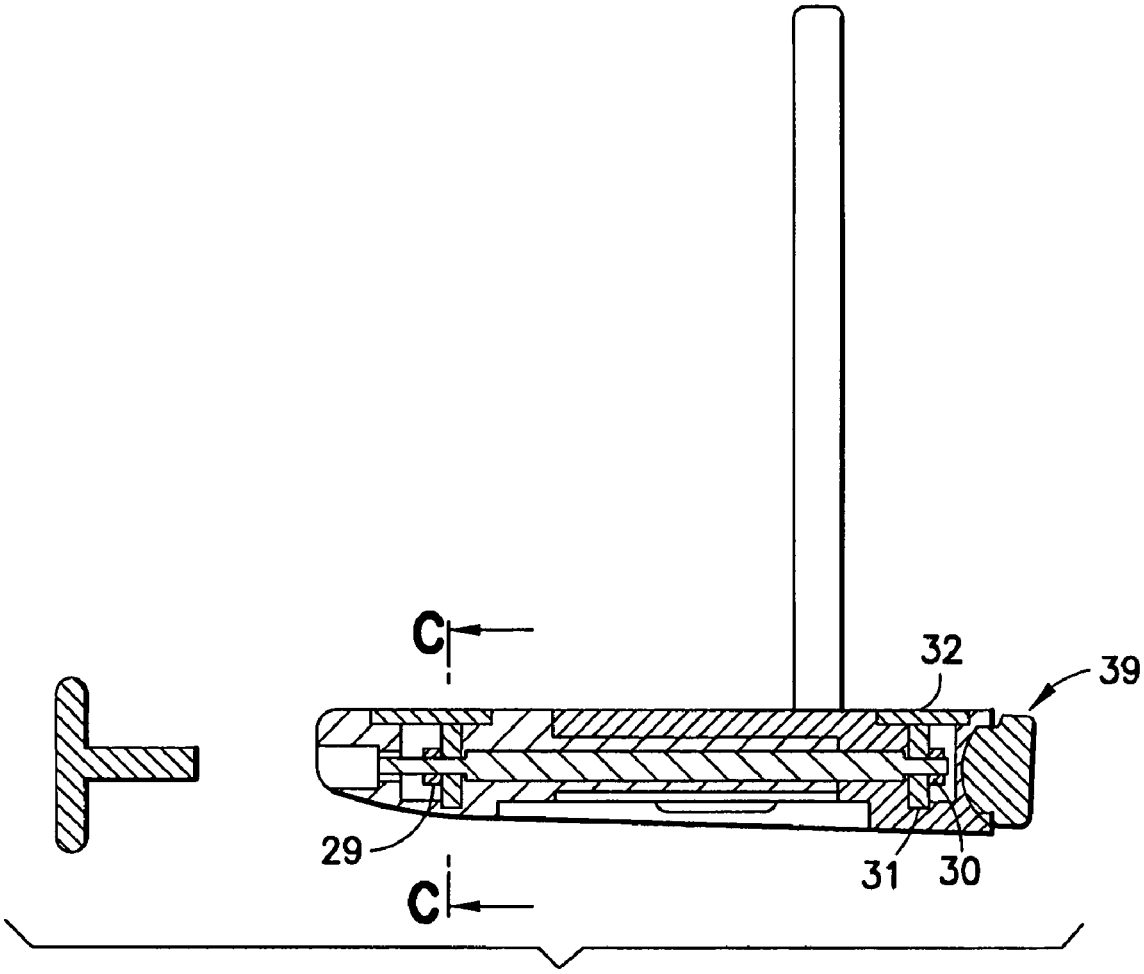
FIG. 12 is a section view of the golf putter of FIG. 8, taken along section line B—B and illustrating other construction details thereof.
Figure 13:
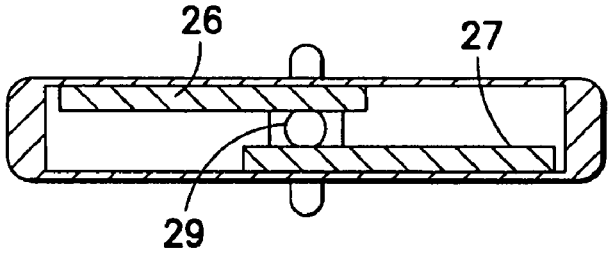
FIG. 13 is a section view of the golf putter of FIG. 12, taken along section line C—C and illustrating additional construction details thereof.

FIG. 11 illustrates articulating component 39 in more detail. Screw or pin 42 moves in oval opening 53 in the manner indicated by arrows F to alter the angle E of ball-striking face 17 with respect to vertical axis X. Component 39 and face 17 articulate about a horizontally orientated axis in the manner indicated by arrow D so that the top-to-bottom cant of face 17 can be adjusted. Face 17 can, if desired, be adjusted to be vertical, The pointer emblem 52A engraved or otherwise formed on component 39 and the arcuate dot sequence 52 engraved or otherwise formed on component 38 enable a golfer to determine the particular setting or orientation of component 39 with respect to component 38 and with respect to vertical axis X. If desired, degree markings can be utilized in place of or in addition to the dot sequence 52.

If desired, the putter 10 can be constructed such that only the position of wing portion 14 can be adjusted and wing portion 15 is maintained permanently in a selected fixed position (or vice-versa) with respect to front portion 16, back portion 13, and neck 12. The fixed position for the wing portion can be the position illustrated in FIG. 1 or can be any other desired position. If wing portion 15 (or 14) is in a fixed position, neck 12 can, if desired, be eliminated from the putter head. The proximate end 22 of shaft 21 can, instead of being connected to wing portion 15, be attached to front portion 16, back portion 13, neck 12, or wing portion 14. Back portion 13 can, if desired, be omitted from the putter head when the putter head is constructed. If desired, when the putter head is constructed only a single wing portion 14 or 15 need be incorporated in the putter head design.

Another embodiment of the invention is illustrated in FIGS. 14 to 23 and 6 and is generally identified by reference character 100. Putter 100 includes a head and a shaft 121. Shaft 121 includes a proximate end 122 connected to the head at aperture 123 and includes a distal end (not shown). The distal end functions as a handle for the golfer to manually grasp the putter shaft. The shape and dimension of shaft 121 can vary as desired (e.g., as discussed above with respect to the embodiment of the earlier figs.).

The head of the putter 100 includes a front portion 116, a back portion 113, and a pair of wing portions 114 and 115. Front portion 116 includes ball striking face 117 and includes component 138 and component 139. Face 117 is part of component 139. Component 139 is mounted on component 138 such that component 139—and face 117—can be pivoted or moved about a horizontal axis to change the top-to-bottom cant or loft of face 117. Wing portions 114 and 115 can be laterally adjusted in the direction of arrows H and G, respectively (see, e.g., FIG. 19), to alter the toe-to-heel weight distribution in the head of the putter, to alter the location of proximate end 122 with respect to the center of gravity of the putter head, and/or to alter the putter head balance orientation. The center of gravity of the head of the putter 100 generally would not substantially change when the positions of wing portions 114 and 115 are adjusted such that portions 114 and 115 each are simultaneously moved equal distances inwardly or outwardly from the distended positions shown in FIG. 14. On the other hand, the center of gravity of the putter head can change if portion 114 is moved a different distance inwardly or outwardly than portion 115 or if the position of only portion 1 14 (or only portion 115) is adjusted. Moving proximate end 122 inwardly from the position shown in FIG. 14 also reduces the magnitude of the torque TI (see, e.g., FIGS. 15 and 16) acting on the toe of the club with respect to proximate end 122, i.e., moving proximate end 122 inwardly (e.g., simultaneously with wing portion 114) from the distended position of wing 114 shown in FIGS. 14 to 17 toward the stowed position of wing 114 shown in FIGS. 19 to 22 causes less rotational force to be acting on proximate end 122.

When the putter 100 is used by a left handed golfer, a shaft 121 can be attached to peg 60 mounted in hosel 61 (of course, any embodiments described herein may be configured for right and/or left hand use).

Figure 23:
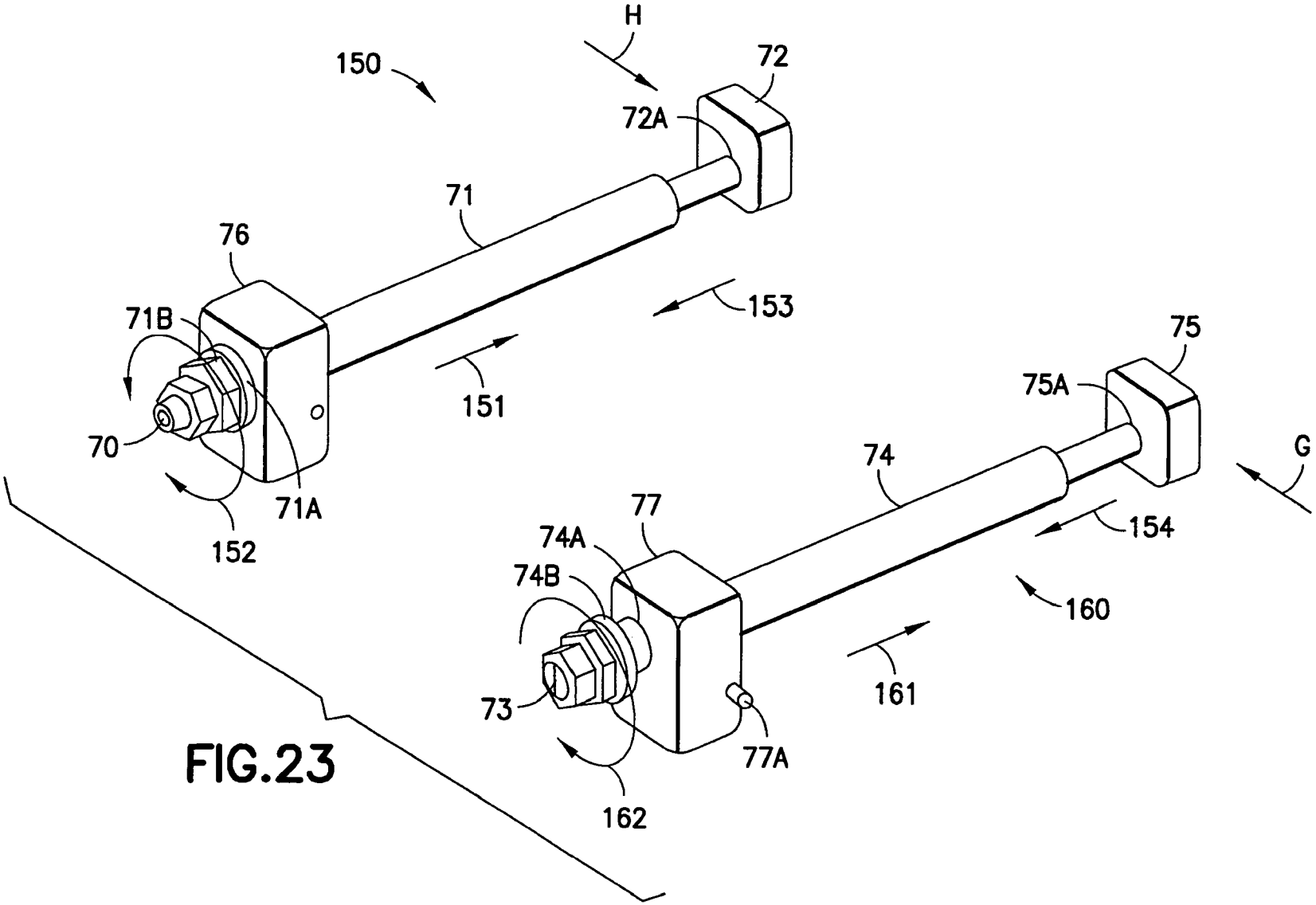
FIG. 23 is a perspective view illustrating components of the linkage system used to laterally adjust the position of the counterweights to alter the heel-to-toe weight distribution of the putter head and lock down the putter components.
Figure 24:
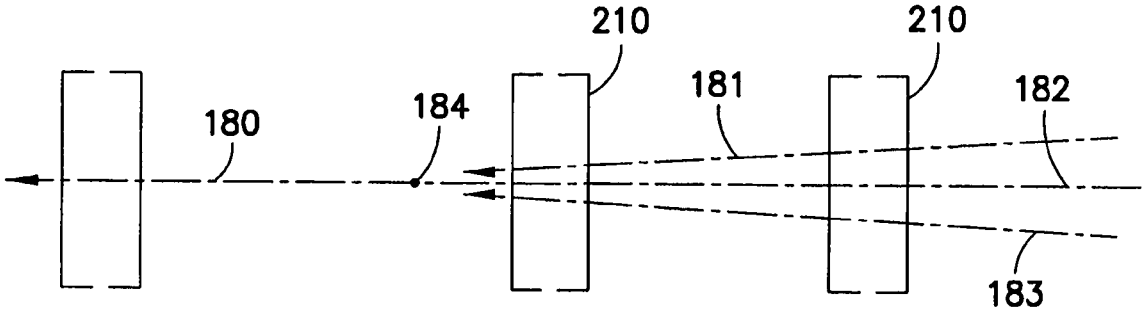
FIGS. 24 and 25 illustrate putting styles.
Figure 25:
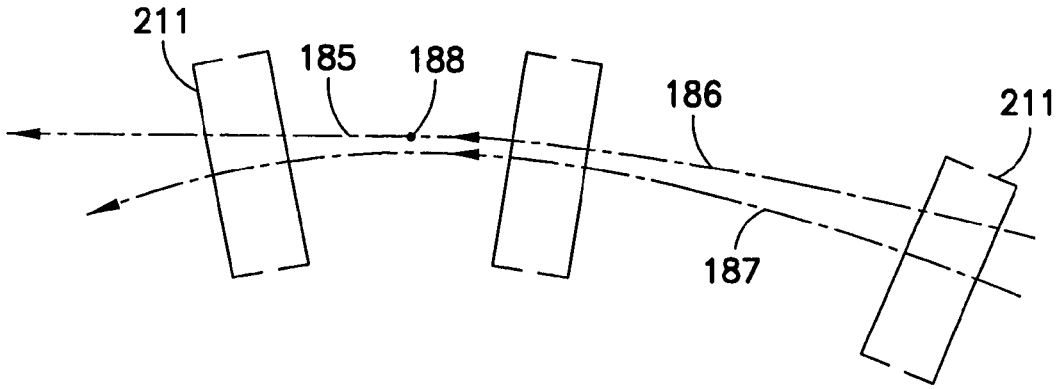

The golf putter 100 is similar to putter 10. Putter 100 does not, however, include a neck comparable to the neck 12 of putter 10. The linkage system of putter 100 is illustrated in FIG. 23 and is different from the linkage system of putter 10. As described below, the linkage system of putter 100 enables each wing portion 114, 115 to be slidably adjusted (e.g., manually) by grasping and pushing or pulling the wing portion inwardly or outwardly, as the case may be.

Figure 14:
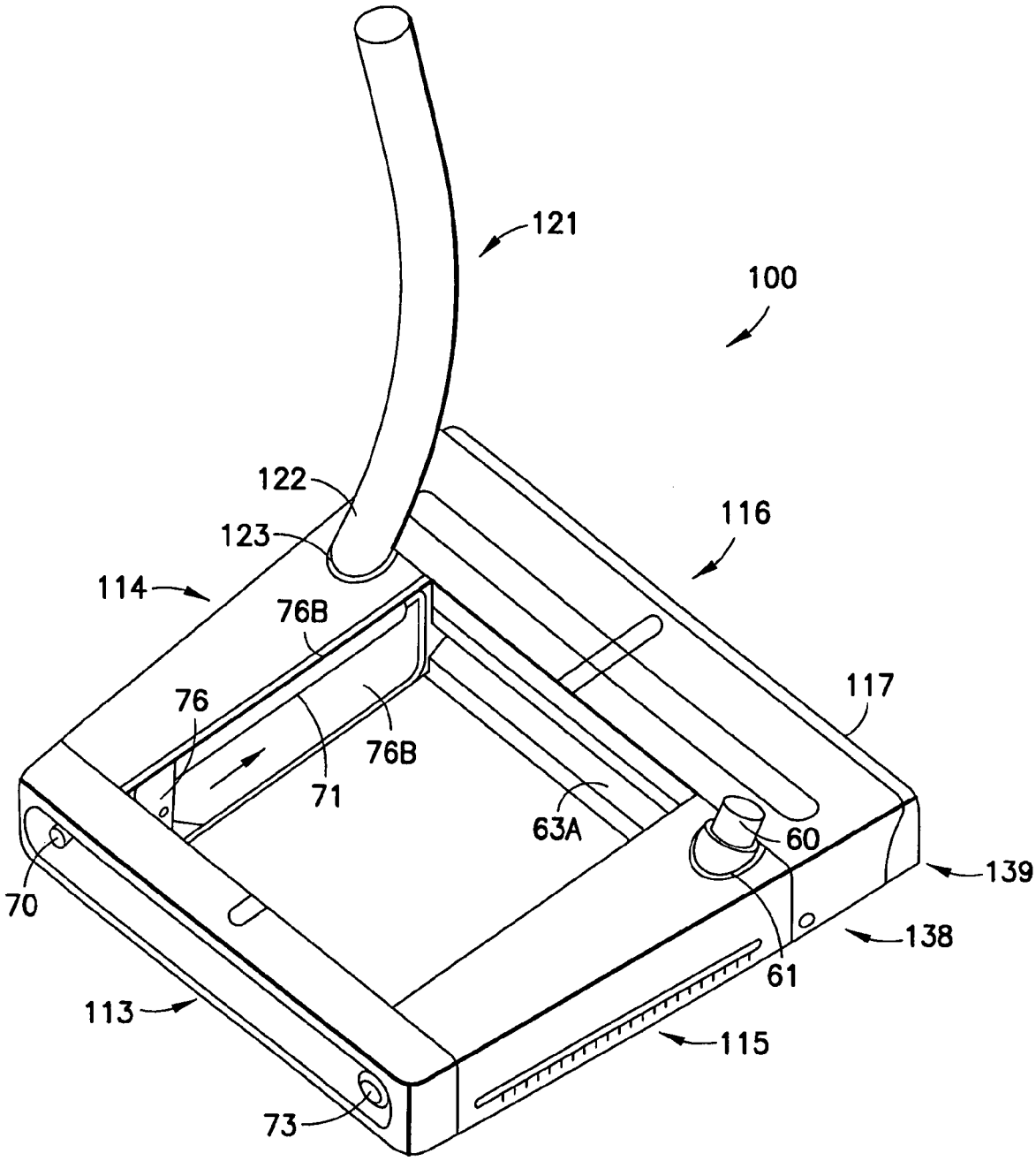
FIG. 14 is a top rear perspective view of a golf putter constructed according to another embodiment of the present invention.
Figure 15:
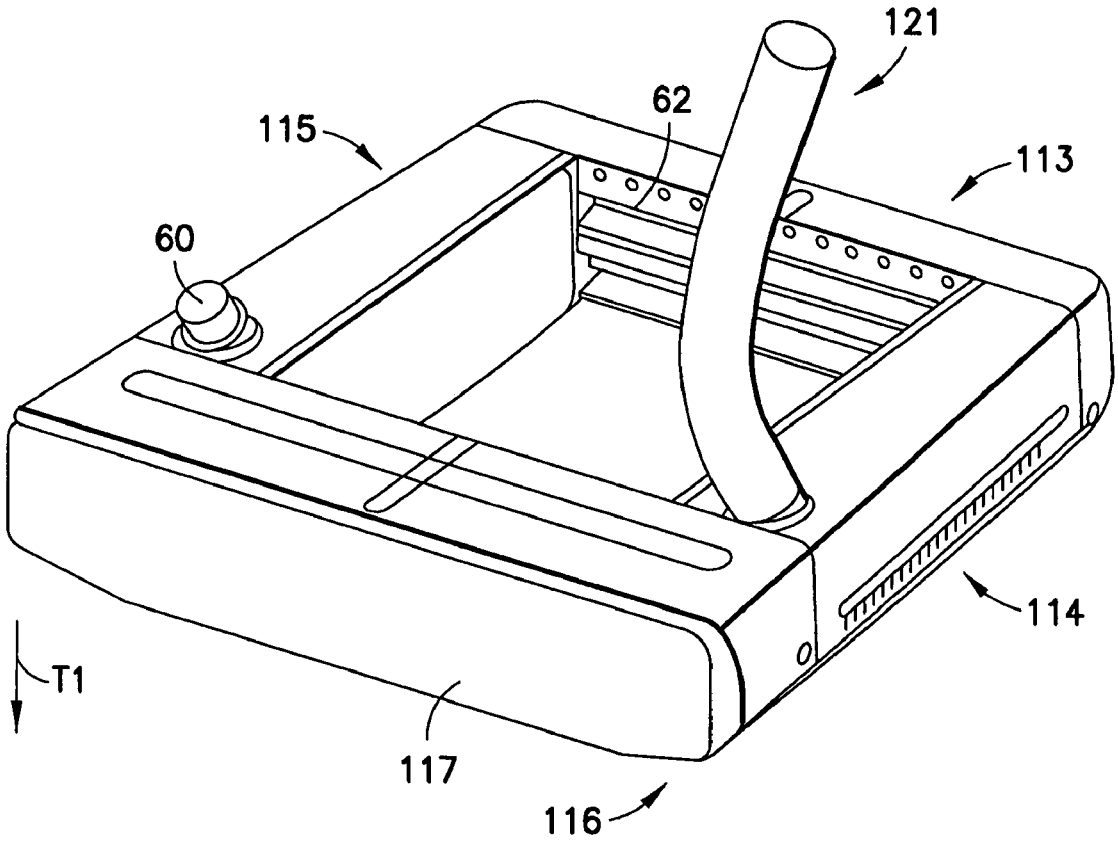
FIG. 15 is a top front perspective view further illustrating the golf putter of FIG. 14.
Figure 16:
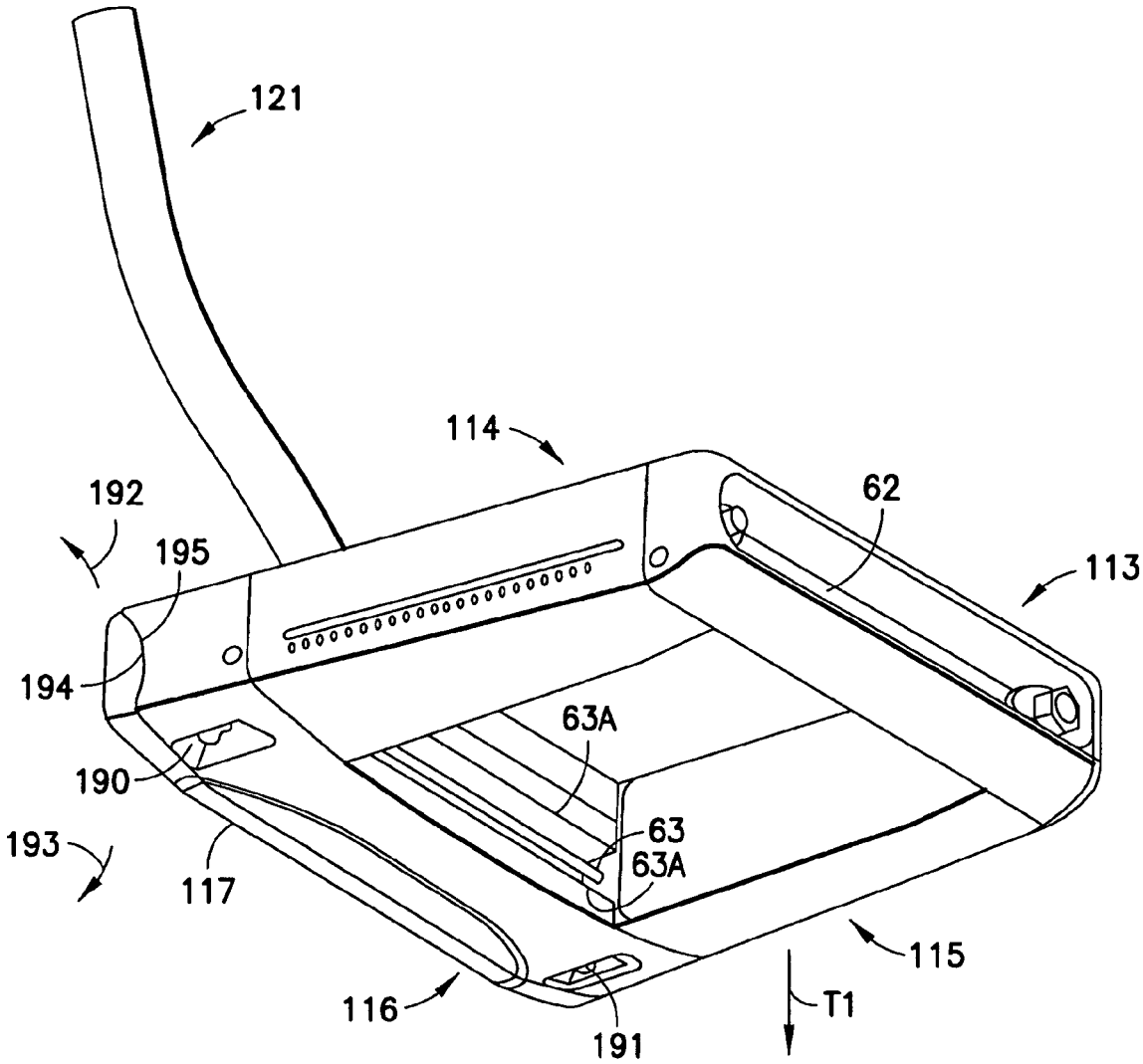
FIG. 16 is a bottom perspective view further illustrating the golf putter of FIG. 14.

In FIG. 23 the linkage system of putter 100 includes linkage system 150 and linkage system 160. System 150 is housed in orthogonal cavity or opening 76B formed in wing 114 (FIG. 14). System 160 is housed in orthogonal cavity or opening 77B formed in wing 115. System 160 includes generally orthogonal foot 75 and weight 77 and includes rod 74. The end of rod 74 extending through foot 75 is externally thread and extends through an internally threaded opening formed through foot 75. Foot 75 slidably seats in orthogonal opening or cavity 63A formed in component 138 of the front portion 116 of putter 100. Foot 75 seats in opening 63A behind rod 63 such that foot 75 can, when wing 115 is in the position shown in FIG. 14, slide along opening 63A behind rod 63 in the direction indicated by arrow G (FIGS. 19 and 23) until wing 115 is in the position shown in FIG. 19, and, such that foot 75 can, when wing 115 is in the position shown in FIG. 19, slide along opening 63 behind rod 63 in a direction opposite that indicated by arrow G until wing 115 returns to the position shown in FIG. 14. Wing 15 can also, as would be appreciated, be slidably adjusted to any position intermediate the positions of wing 115 illustrated in FIGS. 14 and 19 (system 150 may be similarly configured and applied).

Figure 17:
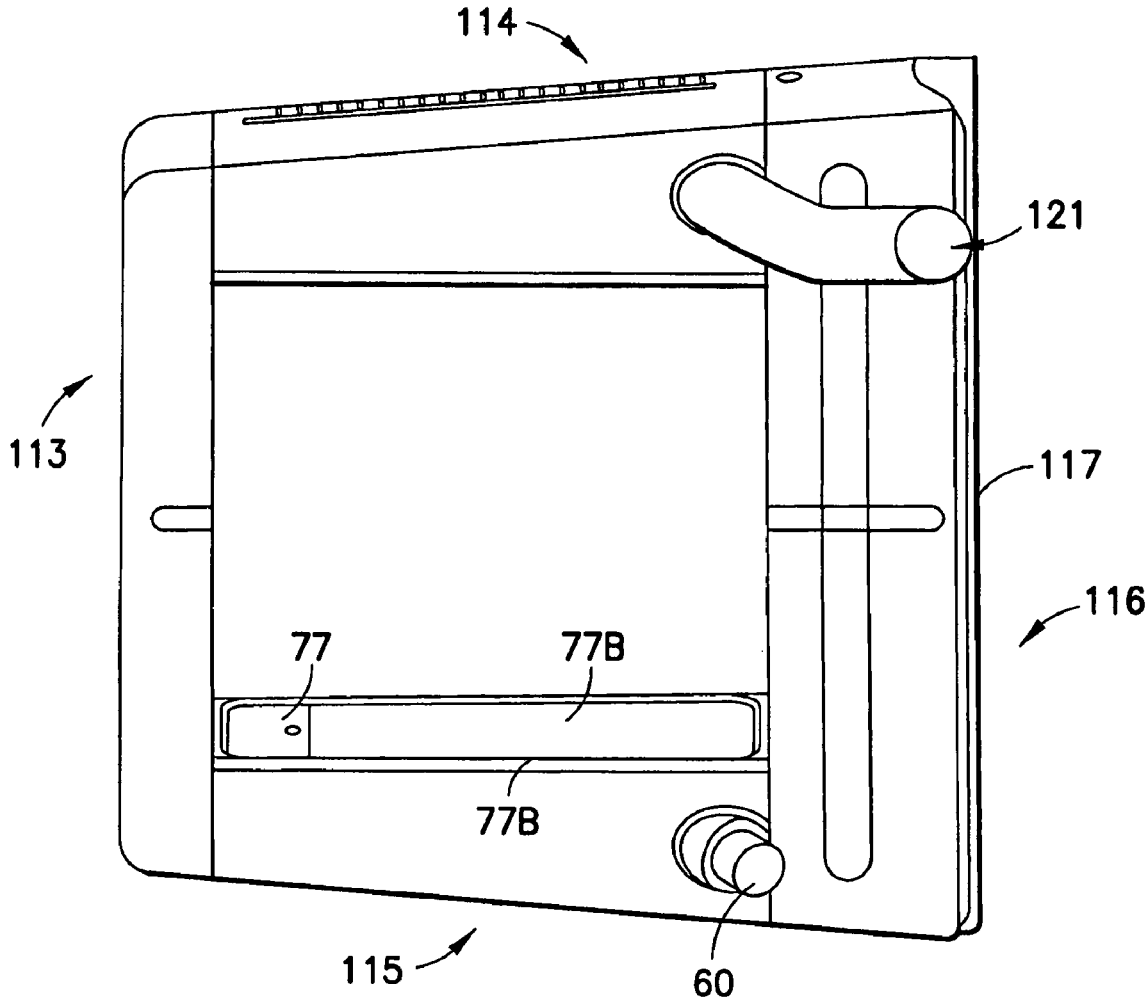
FIG. 17 is a top perspective view further illustrating the golf putter of FIG. 14.
Figure 18:
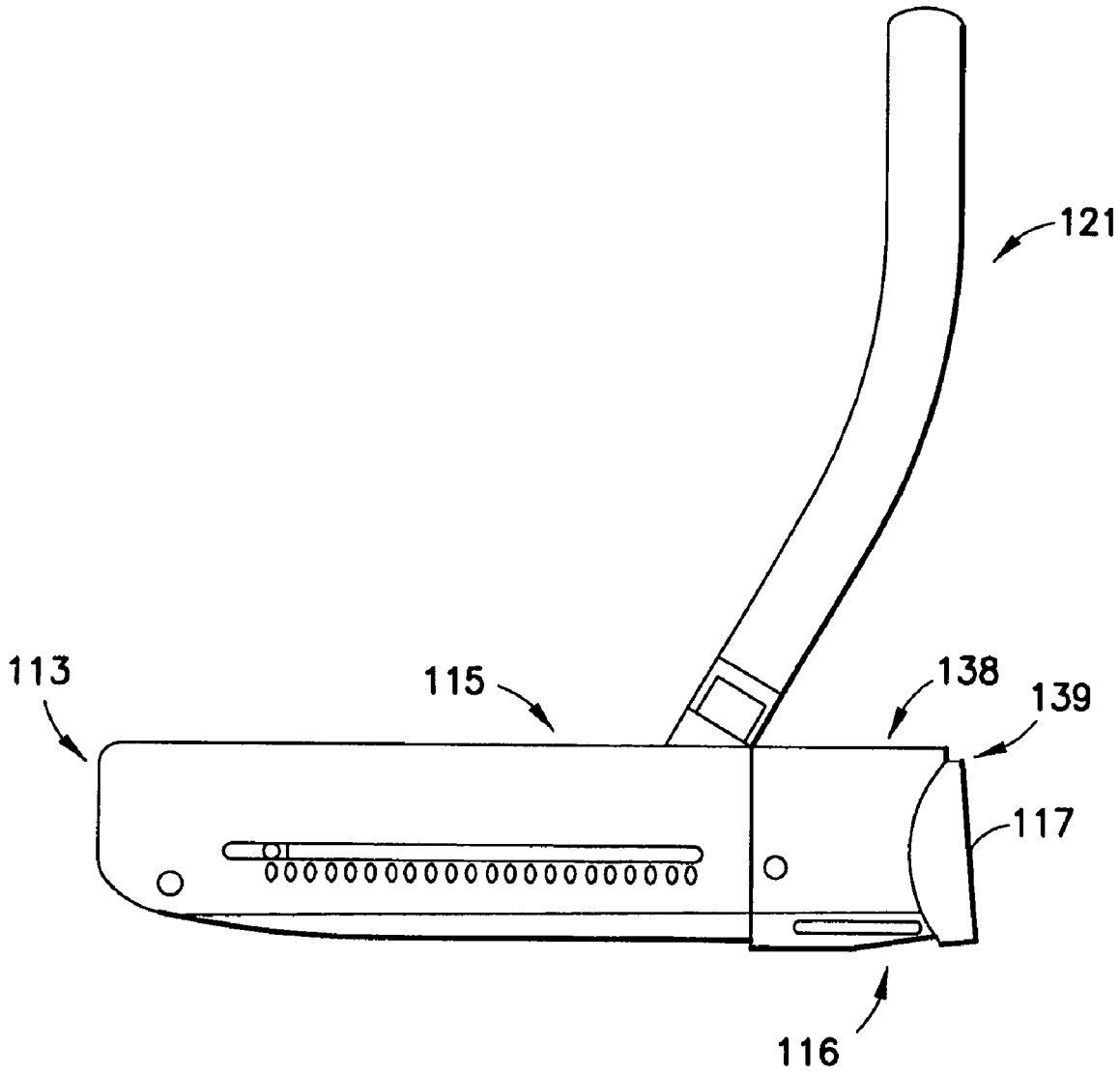
FIG. 18 is a side view further illustrating the golf putter of FIG. 14.

Neck 74A of rod 74 extends through slot 62 (FIG. 16) such that end 73 of rod 74 is positioned outside of slot 62 in the manner shown in FIGS. 14, 16, 19, 21, and so that weight 77 is positioned inside of slot 62 in the manner shown in FIG. 17. Neck 71 A of rod 71 extends through slot 62 (FIG. 16) such that end 70 of rod 71 is positioned outside of slot 62 in the manner shown in FIGS. 14, 16, 19, 21 and such that weight 76 is positioned inside of slot 62 in the manner shown in FIG. 14.

Weight 77 can be slidably moved along rod 74 toward foot 75 in the direction of arrow 161 in FIG. 23 and be secured in a desired position on rod 74 by a set screw 77A. After weight 77 is slidably displaced in the direction of arrow 161 to a desired position on rod 74, weight 77 can, if desired, be slid along rod 74 in a direction 154 opposite that of arrow 161 back toward the position of weight 77 shown in FIG. 23. Consequently, weight 77 can be slid back and forth along rod 74 to a plurality of selected positions intermediate foot 75 and head 73 of rod 74.

Weight 76 can be slidably moved along rod 71 toward foot 72 in the direction of arrow 151 in FIG. 23 and be secured in a desired position on rod 74 by a set screw (not visible). After weight 76 is slidably displaced in the direction of arrow 151 to a desired position on rod 71, weight 76 can, if desired, be slid along rod 74 in a direction 153 opposite that of arrow 151 back toward the position of weight 77 shown in FIG. 23. Consequently, weight 76 can be slid back and forth along rod 71 and detachably secured in a plurality of selected positions intermediate foot 72 and head 70 of rod 71.

Figure 19:
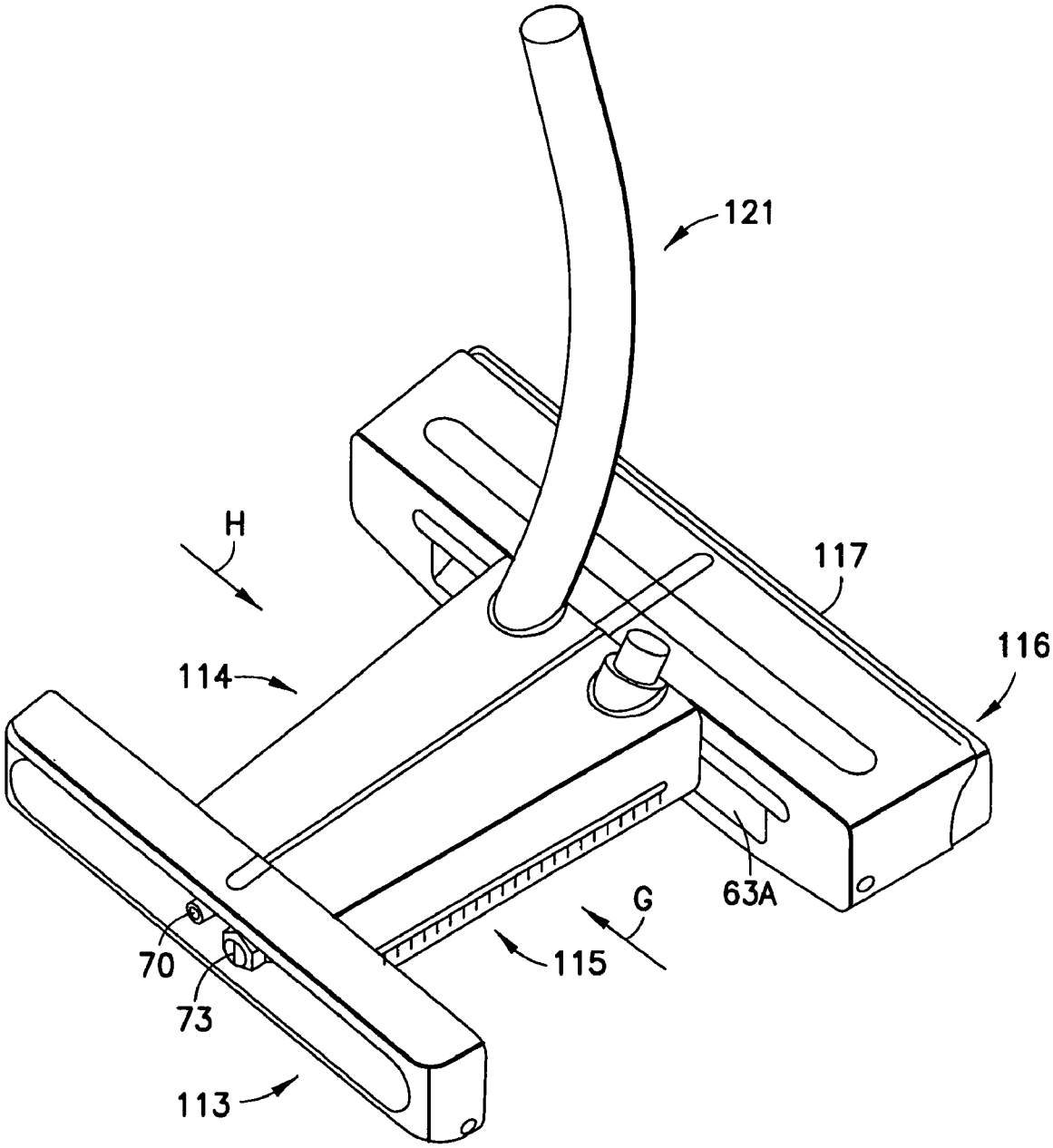
FIG. 19 is a top rear perspective view further illustrating the golf putter of FIG. 14, after the wing portions have been inwardly symmetrically displaced to alter the heel-to-toe weight distribution of the putter head.
Figure 20:
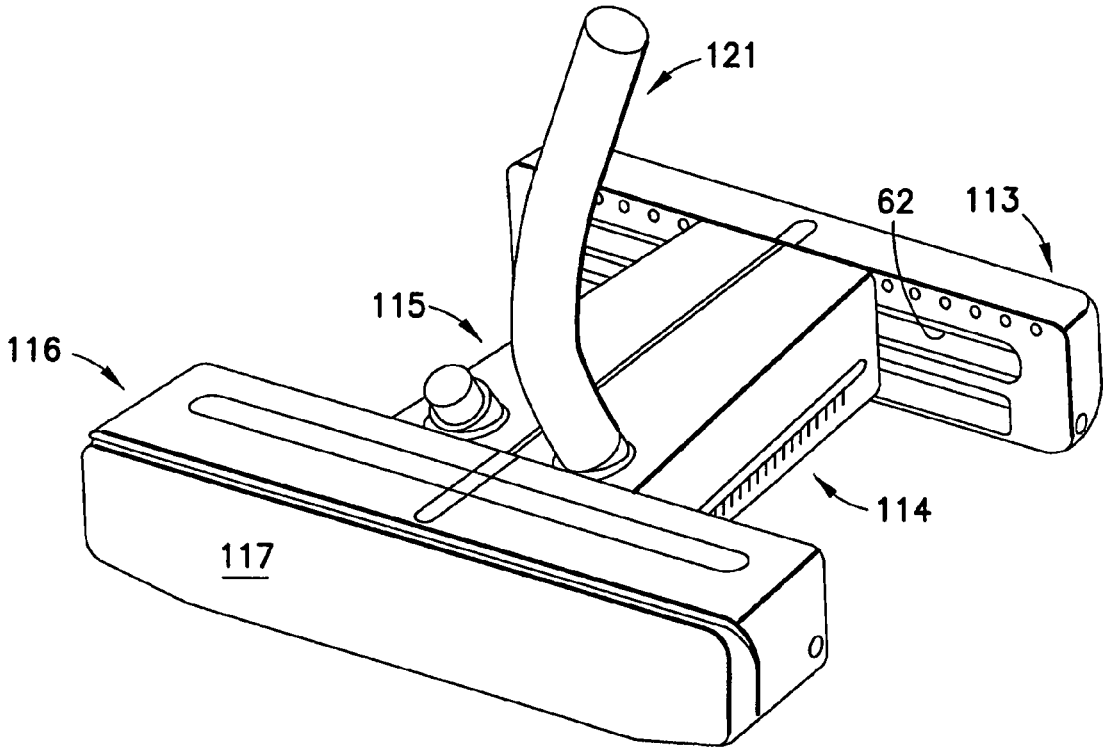
FIG. 20 is a top front perspective view of the golf putter of FIG. 19.
Figure 21:
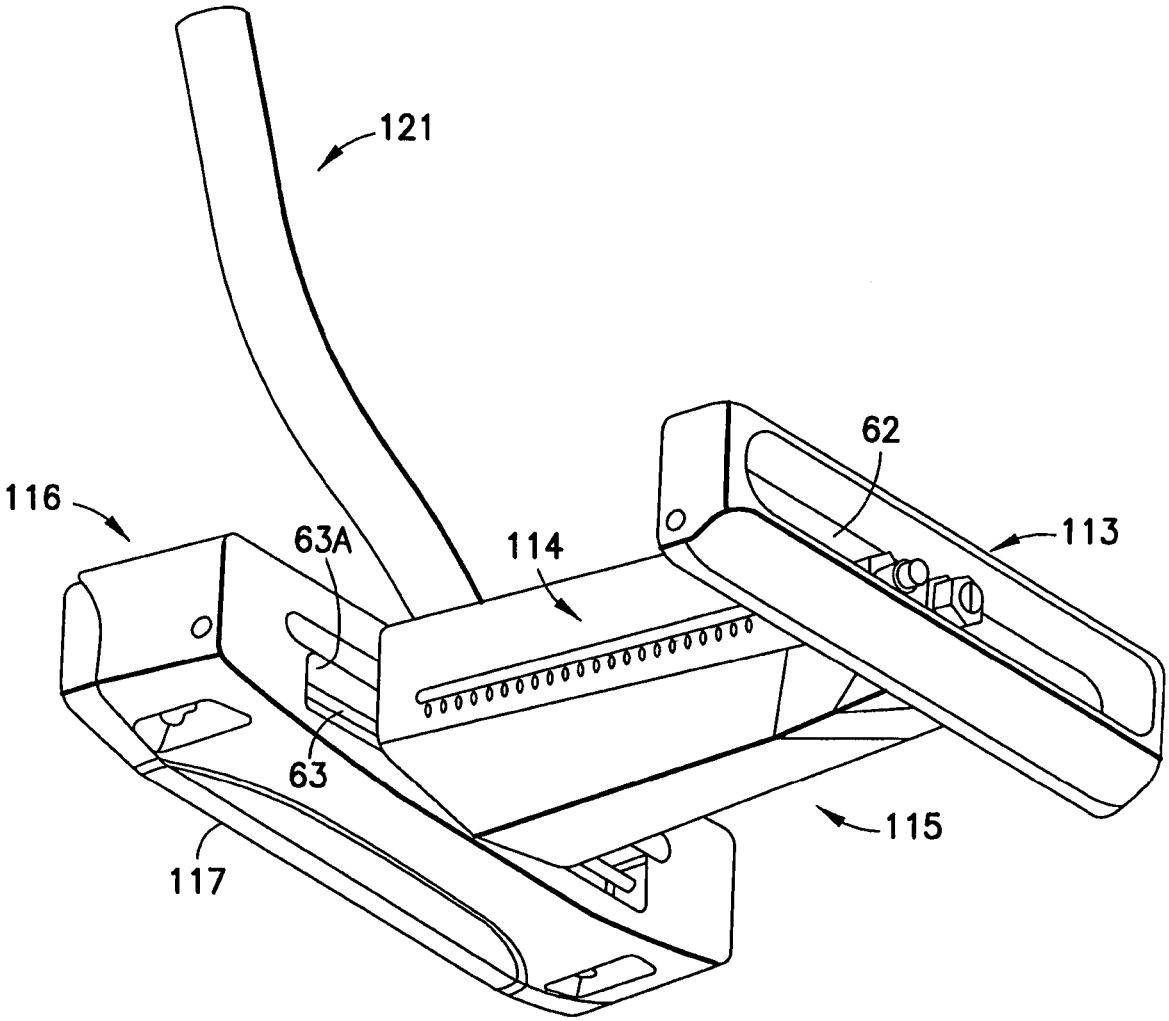
FIG. 21 is a bottom rear perspective view of the golf putter of FIG. 19.
Figure 22:
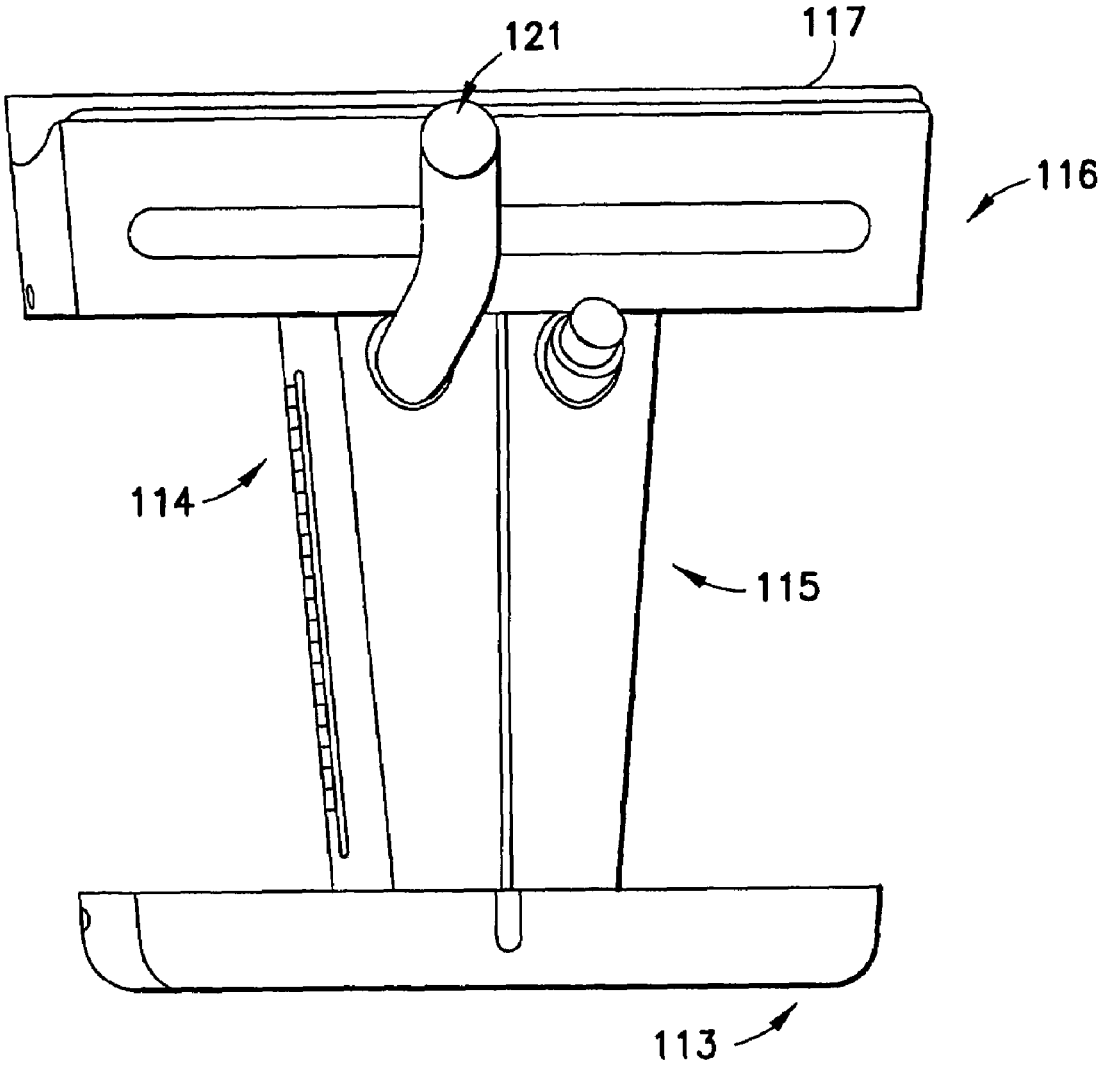
FIG. 22 is a top view of the golf putter of FIG. 19.

As is illustrated in FIG. 19, wing portion 115 can be manually slid in the direction of arrow G from the position illustrated in FIG. 14 to the position shown in FIG. 19. Wing portion 114 can be manually slide from the position illustrated in FIG. 14 to the position shown in FIG. 19.

When end 73 is turned in the direction of arrow 162, the externally threaded end of rod 74 turns through internally threaded aperture 75A. This draws foot 75 against a back wall of a cavity that is hollowed out of component 138, presses washer 74B against back portion 113 and tightens or compresses wing 115 in position between back portion 113 and front portion 116. Turning end 73 in a direction opposite that of arrow 162 loosens foot 75, and permits wing 115 to be slid in the direction of arrow G and, after wing 115 is displaced inwardly from the position shown in FIG. 14, in a direction opposite that of arrow G. Front portion 116 includes components 139 and 138. Component 139 includes ball striking face 117.

When end 70 is turned in the direction of arrow 152, the externally threaded end of rod 71 turns through internally threaded aperture 72A. This draws foot 72 against rod 63 and presses washer 71B against back portion 113 and tightens or compresses wing 114 in position between back portion 113 and front portion 116. Turning end 70 in a direction opposite that of arrow 152 loosens foot 72, and permits wing 114 to be slid in the direction of arrow H (FIG. 19) and, after wing 114 is displaced inwardly from the position shown in FIG. 14, in a direction opposite that of arrow H. Front portion 116 includes components 139 and 138. Component 139 includes ball striking face 117. The proximate end 122 of shaft 121 is fixedly inserted in hosel 123.

Of note, the putter illustrated in FIGS. 14 to 23 and 6 (as well as various other putters described herein) permits ready adjustment of the putter head balance orientation between the face-balanced orientation and the toe-weighted orientation (as well as any desired intermediate orientation).

In this regard, when the putter head is in the configuration illustrated in FIG. 19, the putter head has a face-balanced (or nearly face-balanced) orientation. In FIG. 19, weights 76 and 77 are in the position shown in FIG. 23.

On the other hand, when the putter head is in the configuration illustrated in FIG. 14, the putter head has an intermediate orientation (e.g., in which the ball striking face of the putter head is in the range of twenty to eighty degrees from the horizontal). In FIG. 14, weights 76 and 77 are still in the position shown in FIG. 23 (i.e., next to back portion 113). To increase the angle from the horizontal of the ball striking face 117 of the putter head, the position of weights 76 and/or 77 may adjusted along rods 71, 74 in the direction of arrows 151 and 161, respectively. When the weights 76, 77 are adjusted as far as possible along rods 71, 74 (and toward the front portion 116 of the putter head) the putter head will assume a toe-weighted (or nearly toe-weighted) orientation. If the weights 76, 77 are adjusted in the direction of arrows 151, 161, respectively, only a part of their greatest possible distance of travel along rods 71, 74 in the direction of arrows 151, 161, then the putter head will take an intermediate orientation.

As would be appreciated by those of skill in the art, it is possible to configure a putter such that only the adjustment of wings 114 and 115 would be required to move face 117 between a face-balanced orientation and toe-weighted orientation or any desired orientation therebetween.

The orientation, or cant or loft, of component 139 and face 117 is adjusted by loosening screws 190 and 191 (FIG. 16); by manually adjusting in the direction of arrows 192 and 193 the convex back surface 194 of component 139 over the opposing, conforming concave surface 195 of component 138 until component 139 reach the desired position; and, by tightening screws 190 and 191 to fix component 139 in position. Externally threaded screws 190 and 191 extend through vertically extending slots formed in component 138 and also extend into internally threaded cylindrical apertures formed in component 139.

Figure 28:
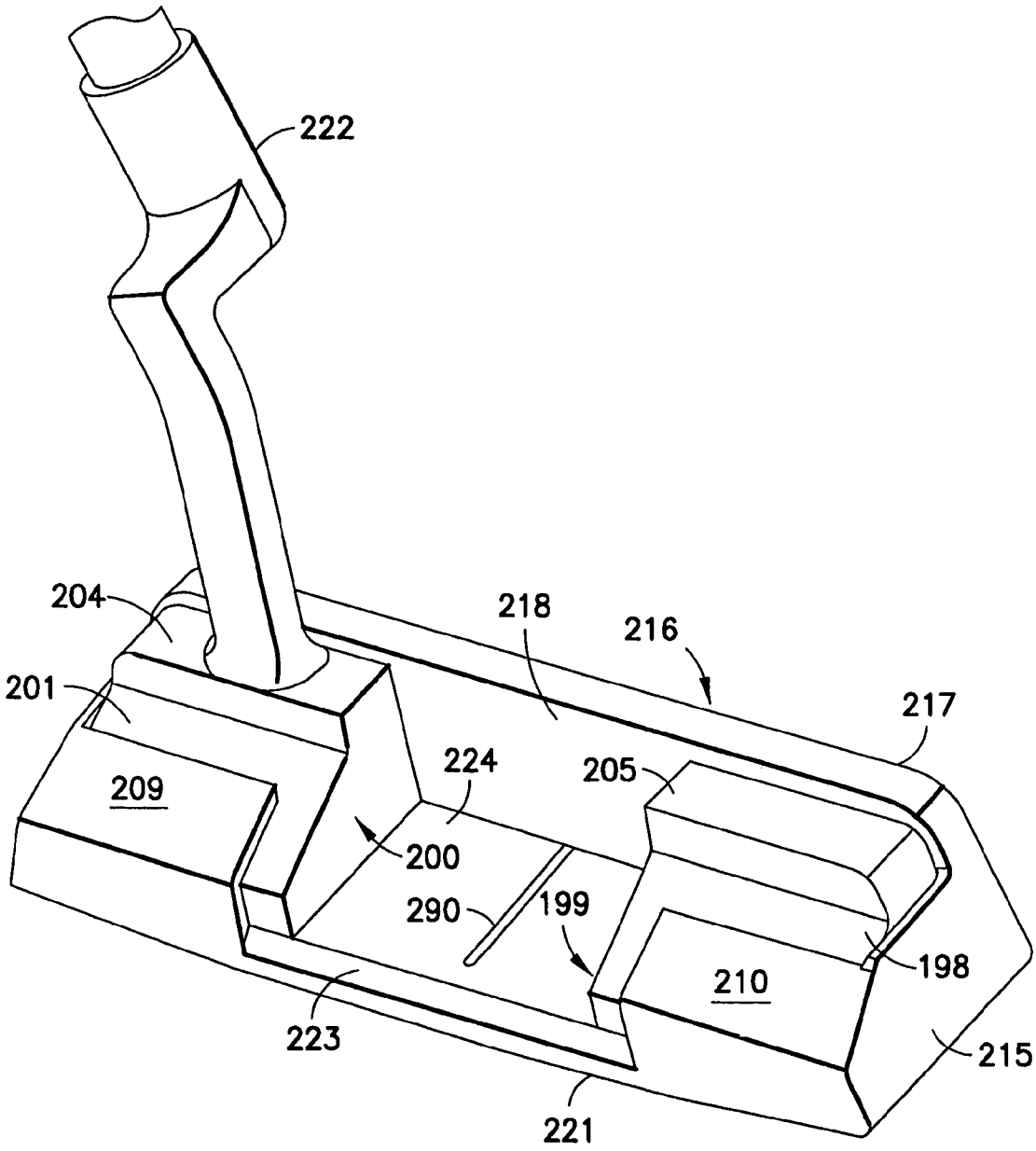
FIG. 28 is a rear perspective view further illustrating the golf putter of FIG. 26, with the sliding portions slidably spaced apart from the positions shown in FIG. 26, which sliding portions are positioned to produce a toe-weighted (or "toe hanger") putter head.
Figure 29:
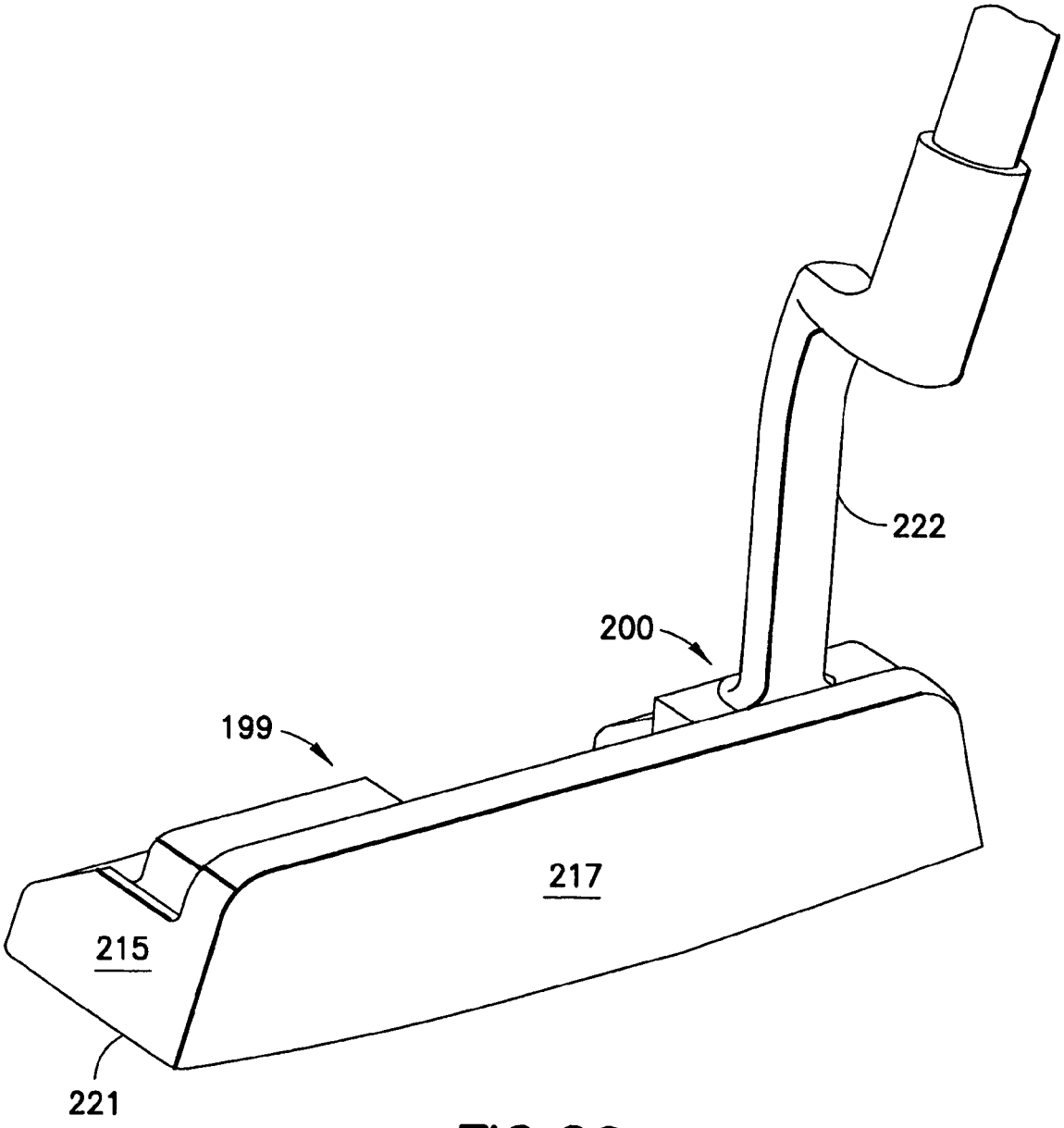
FIG. 29 is a front perspective view further illustrating the golf putter of FIG. 28.
Figure 30:
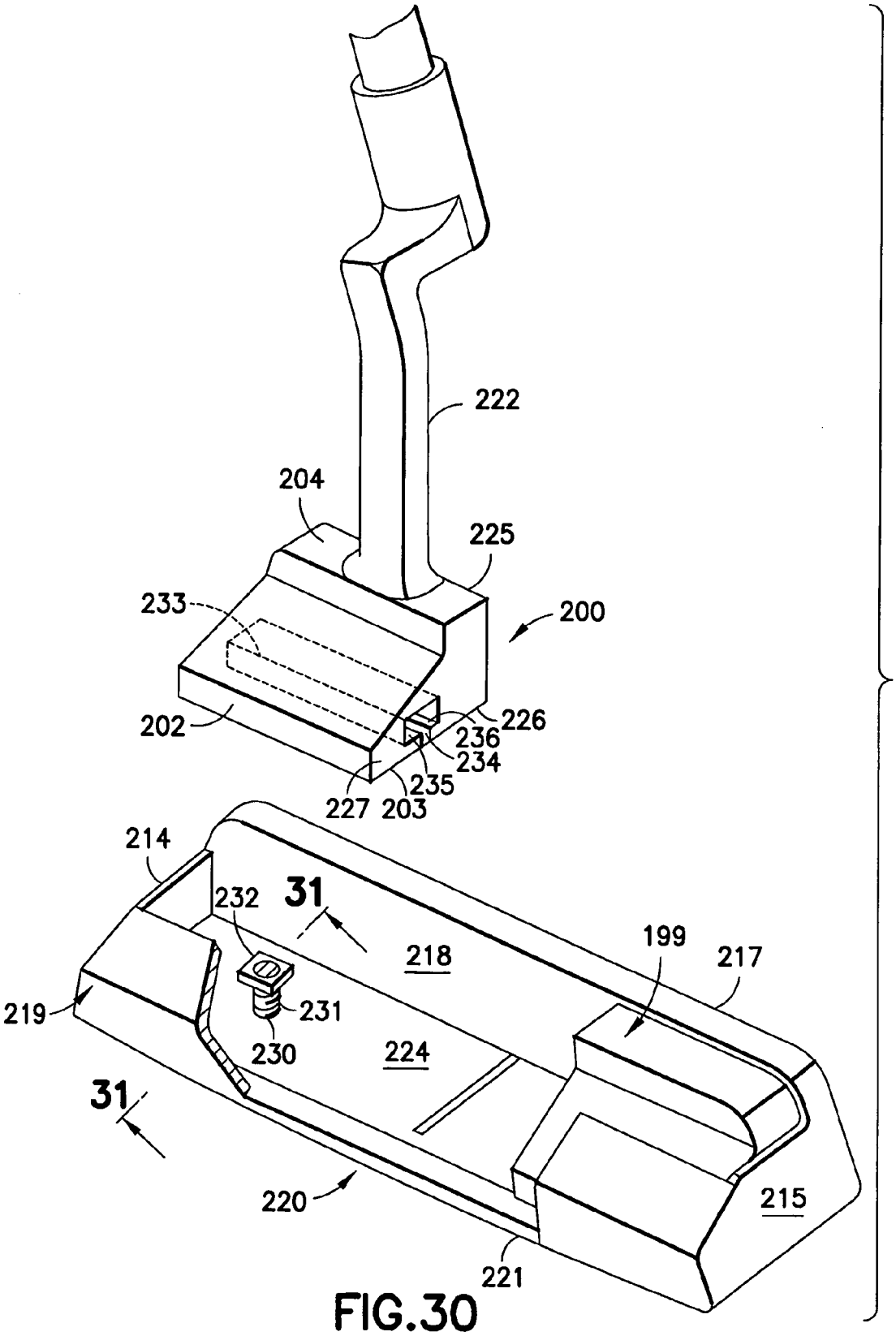
FIG. 30 is an exploded view of the golf putter of FIG. 26 further illustrating construction details thereof.

FIGS. 26 to 31 illustrate another embodiment of the golf putter of the invention. The putter includes a shaft 222 having a distal end (not visible) with a grip or handle and a proximate end fixedly (or removably, if desired) connected to the top 204 of slidable balancing portion 200. Balancing portion 200 includes canted face 197, vertically oriented face 202, bottom 203, and back 225 (FIG. 30). Slidable balancing portion 199 includes top 205, canted face 198, vertically oriented face 206, bottom 207, and a back. The shape and dimension of portion 199 is shown as essentially identical to that of portion 200, although this need not be the case.

Bottoms 203 and 207 slidably contact the upper surface 224 (FIG. 28) of the horizontally oriented foot 220 of the putter head. Foot 220 rearwardly depends from ball striking portion 216. Foot 220 includes horizontally oriented bottom surface 221, spaced apart upstanding end panels 214 and 215, and front panels 210 and 219. Panels 210 and 219 upwardly depend from surface 224 and function to guide portions 199 and 200 as they slide over surface 224 and also function to house portions 199 and 200 and to help maintain portions 199 and 200 in contact with surface 224. The backs 225 of portions 199 and 200 slide over the back 218 of ball striking portion 216. Foot 220 also includes canted lip 223.

Figure 26:
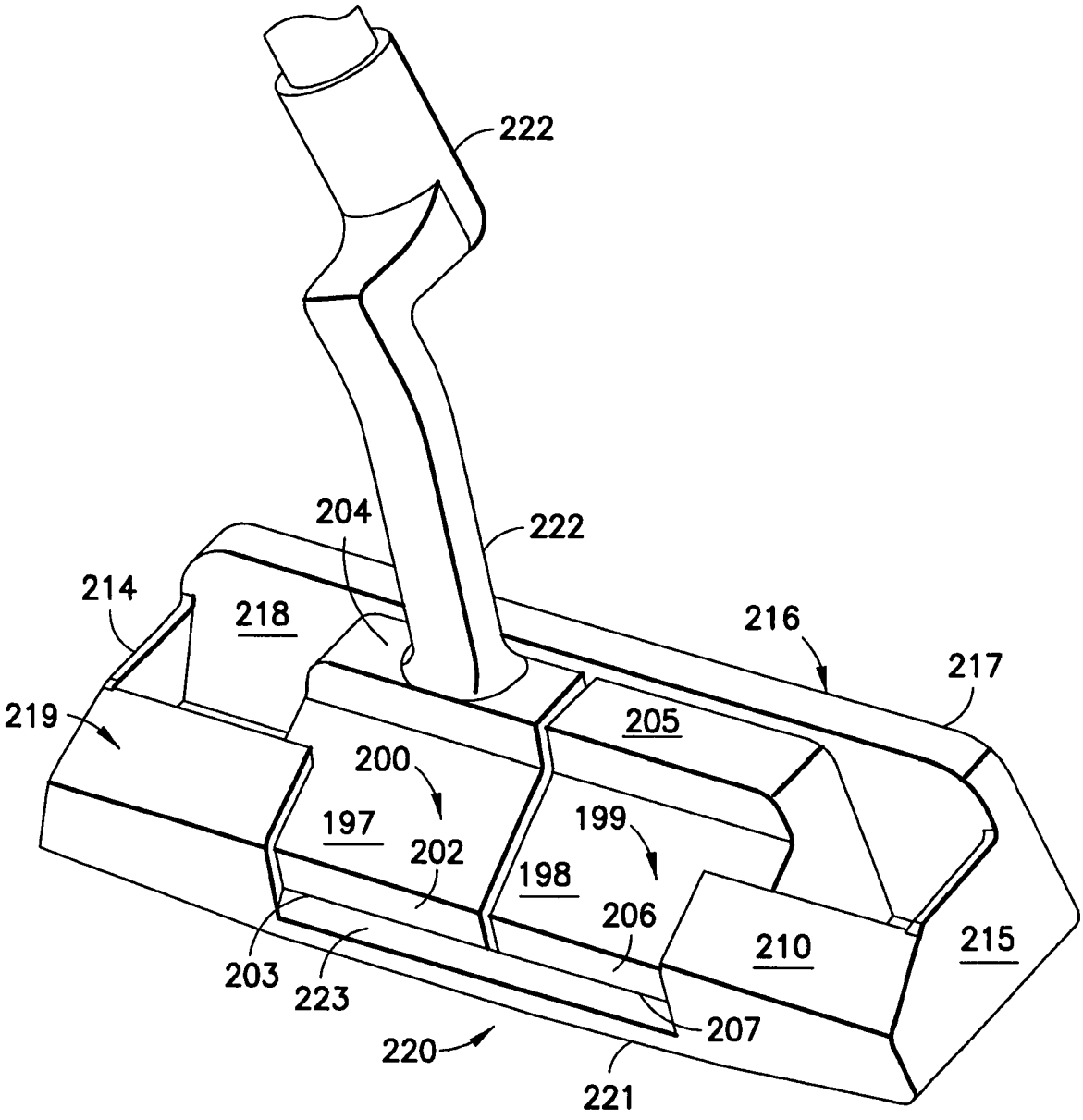
FIG. 26 is a rear perspective view of another embodiment of the golf putter of the present invention including sliding portions adjustable to alter the balance and weight distribution of the putter head, which sliding portions are positioned to produce a face-balanced putter head.
Figure 27:
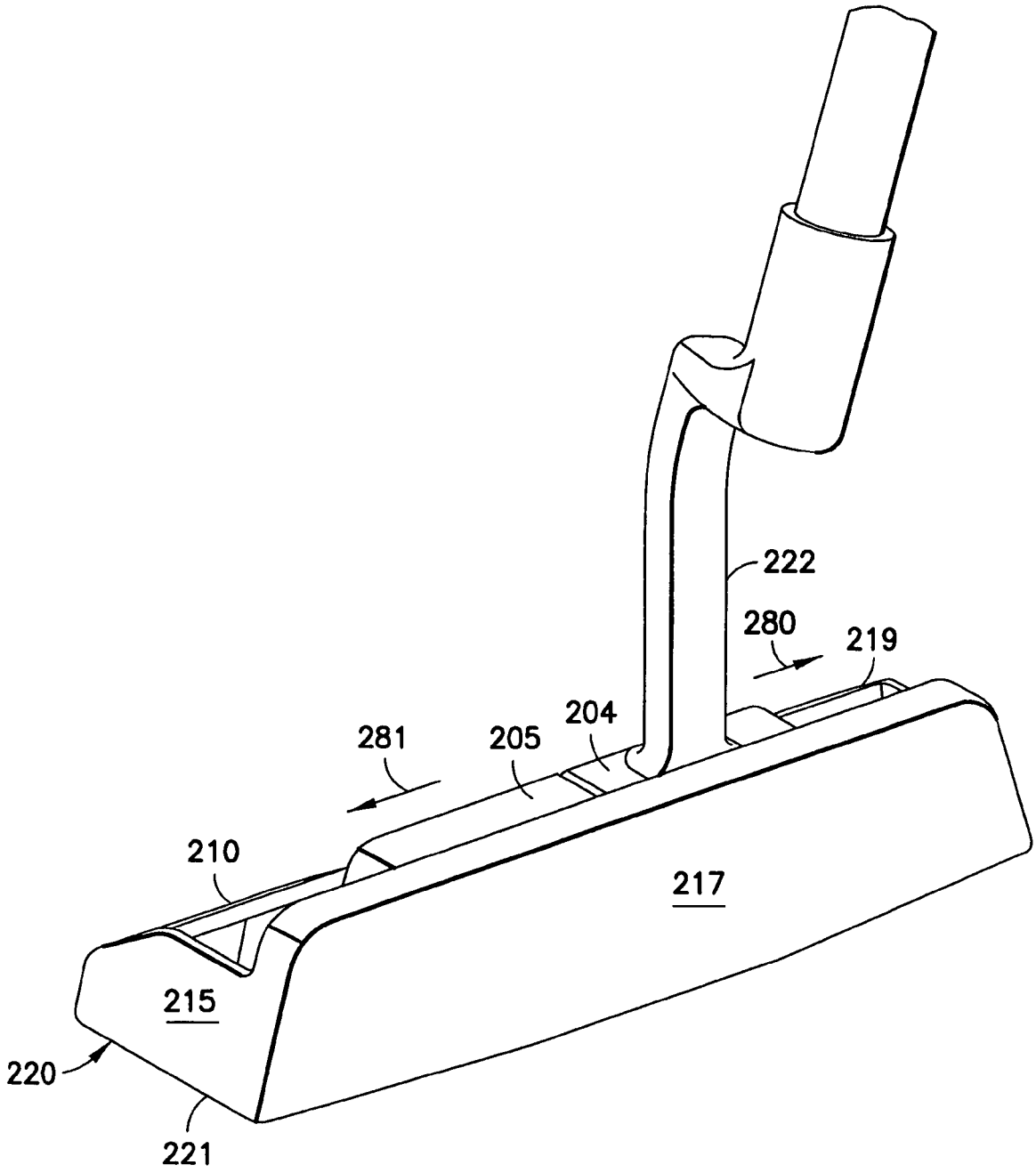
FIG. 27 is a front perspective view further illustrating the golf putter of FIG. 26.

In FIGS. 26 and 27, portions 199 and 200 are illustrated in a position in which they each contact the other and are slid together such that one end of each portion 199 and 200 is positioned over the center line 290 (FIG. 27) of the foot 220 of the putter head. The position of portions 199 and 200 in FIGS. 26 and 27 produces, or nearly produces, a putter head with a face-balanced orientation.

In FIGS. 28 and 29, portions 199 and 200 are illustrated in positions in which they have been slid apart to the furthest possible extent of travel such that portion 200 is adjacent panel 214 and portion 199 is adjacent panel 215. Each portion 199, 200 can, of course, also be slid to positions intermediate those shown in FIGS. 26 and 28. Portion 199 can (while portion 200 remains in the position shown in FIG. 28), be slid toward portion 200 and over centerline 290 such that a section of portion 199 rests on surface 224 between centerline 290 and portion 200 in FIG. 28. Portion 200 can (while portion 199 remains in the position shown in FIG. 28) be slid toward portion 199 and over centerline 290 in FIG. 28 such that a section of portion 200 rests on surface 224 between centerline 290 and portion 200 in FIG. 28.

The position of portions 199 and 200 in FIGS. 28 and 29 produces, or nearly produces, a putter head that has a toe-weighted balance orientation.

Figure 31:
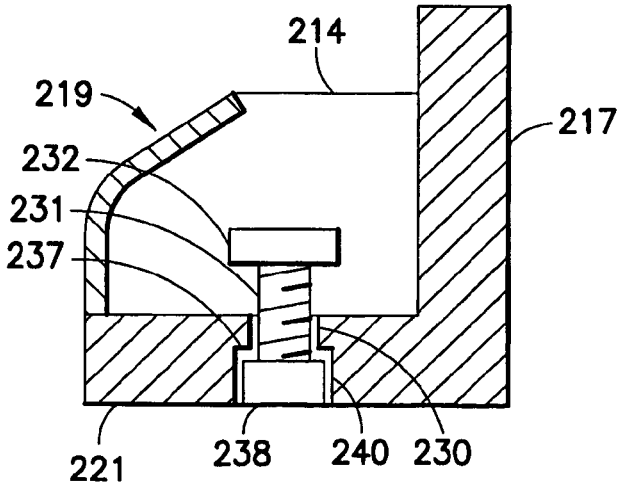
FIG. 31 is a section view of the golf putter of FIG. 30, illustrating internal construction details of the putter of FIG. 30 and taken along section line 31—31 thereof.

Any desired means may be utilized to secure a portion 199 or 200 at a desired location on and along surface 224 of foot 220. One example system (which example is intended to be illustrative and not restrictive) is illustrated in FIGS. 30 and 31. Each portion 200 includes a T-shaped slot 233 formed therein. Slot 233 includes horizontally oriented ledges 235 and 236, and includes vertically extending opening 234. The upper portion (i.e., the top of the T) of slot 233 is shaped to slidably receive square nut 232. The distal end of threaded leg 231 turns into nut 232 in the manner illustrated in FIGS. 30 and 31. The proximate end of leg 231 is fixedly attached to head 238. Head 238 nests and is seated in opening 240. The external diameter of head 238 is greater than that of cylindrically shaped opening 230 extending through foot 220. Head 238 is therefore prevented from moving into opening 230. Head 238 may include an opening (not visible in FIGS. 30 and 31) shaped to receive an Allen wrench or other desired adjustment tool such that the tool (e.g., Allen wrench) can be used to turn head 238 and leg 231 such that the distal end of leg 231 turns into or out of nut 232.

When the distal end of leg 231 is turned into nut 232, head 238 is drawn against the bottom of opening 240 and nut 232 is pulled against a portion of ledges 235 and 236. Thus, pulling or tightening nut 232 against ledges 235 and 236 secures portion 200 in place on foot 220 and prevents foot from sliding along surface 224 of foot 220 in the directions indicated by arrow 280 or arrow 281.

Using the tool (e.g., an Allen wrench) to turn head 238 and leg 231 out of nut 232 loosens nut 232 such that when portion 200 is slid along surface 224 in the direction of arrow 280 or 281 (FIG. 27), T-shaped slot slides over nut 232 and over the portion of leg 231 extending in FIG. 30 between surface 224 and nut 232. Portion 199 is provided with a securing system that is not visible in the drawings but that is equivalent to the system provided for portion 200. The shape and dimension of balancing portions 199, 200 can vary as desired.

Figure 32:
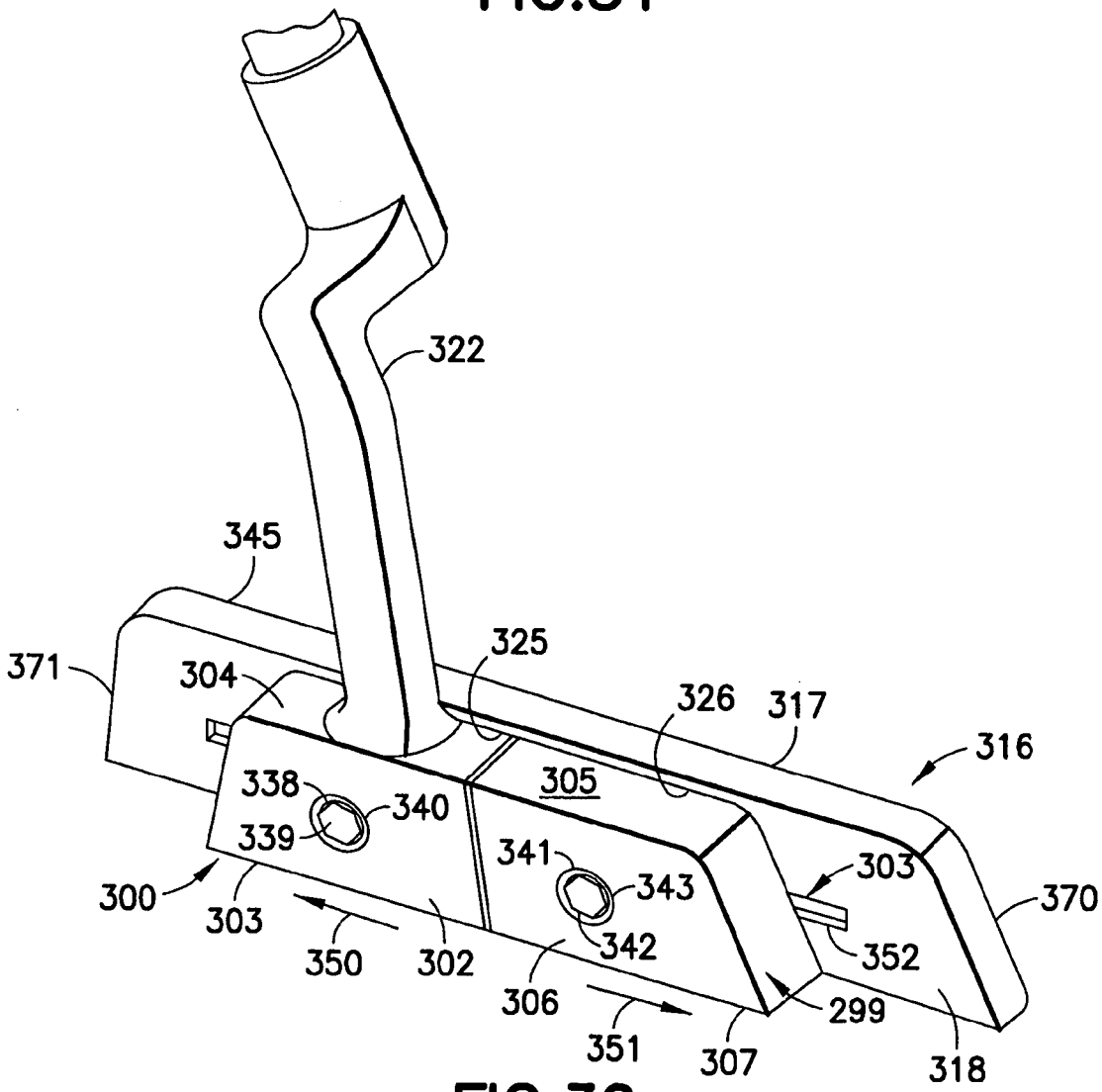
FIG. 32 is a rear perspective view of another embodiment of the golf putter of the present invention.

FIG. 32 illustrates another embodiment of the golf putter of the invention. The putter includes a shaft 322 having a distal end (not visible) with a grip or handle and having a proximate end fixedly (or removably, if desired) connected to the top 304 of generally orthogonal slidable balancing portion 300. Balancing portion 300 includes vertically oriented face 302, bottom 303, and back 325. Slidable balancing portion 299 includes top 305, vertically oriented face 306, bottom 307, and a back 326. The shape and dimension of portion 300 is shown as essentially identical to that of portion 299, although this need not be the case.

In FIG. 32, portions 299 and 300 are illustrated in a position in which they each contact the other and are slid together such that one end of each portion 299 and 300 is immediately adjacent an end of the other portion 299 and 300 and such that one end of each portion 299 and 300 is positioned over the center of the back surface 318 of the ball striking portion 316 of the putter head. The position of portions 299 and 300 in FIG. 32 produces, or nearly produces, a putter head with a face-balanced orientation.

Portions 299 and 300 can be slid apart to the furthest possible extent in the directions indicated by arrows 351 and 350, respectively, in the same manner that portions 199 and 200 are slid apart in FIGS. 28 and 29. If desired, the putter can be constructed such that sections or portions 299 and 300 can, after portions 299 and 300 are appropriately positioned on portion 316, extend outwardly past ends 370 and 371. FIGS. 28 and 29 illustrate positions where the portions 299 and 300 may be positioned to produce an essentially toe-weighted putter head.

Any desired means may be utilized to secure a portion 299 or 300 at a desired location on back surface 318 of ball striking portion 316. One example system (which example is intended to be illustrative and not restrictive) is partially visible in FIG. 32 and is similar to the securing system illustrated in FIGS. 30 and 31. More particularly, ball striking portion 316 includes a T-shaped slot 303 that is formed therein and that is similar to T-shaped slot 233. Slot 303 includes ledges similar to ledges 235 and 236 in slot 233 and includes opening 352 similar to opening 234 in slot 233. Slot 303 is, like slot 233, shaped to slidably receive a square nut (not visible) having a shape equivalent to that of nut 232. The distal end of an externally threaded leg that is equivalent to leg 231 turns into the square nut in the same manner as illustrated in FIGS. 30 and 31 for leg 231. The proximate end of the externally threaded leg is fixedly attached to the head 338. Head 338 nests and is seated in opening 340. The external diameter of head 338 is greater than that of a cylindrically shaped leg opening (not visible) that depends from and extends inwardly toward portion 316 from opening 340. This leg opening receives the externally threaded leg connected to head 338. The cylindrically shaped leg opening extends from opening 340 completely through portion 300. Head 338 remains seated in opening 340 and is prevented from moving into the cylindrically shaped leg opening formed in portion 300. Head 338 includes a feature such as an opening 339 shaped to receive a tool (e.g., an Allen wrench) such that the tool can be used to turn head 338 and the externally threaded leg attached to head 338 such that the distal end of the externally threaded leg turns into or out of the square nut that is in T-shaped slot 303.

When the distal end of the externally threaded leg attached to head 338 is turned into the square nut in slot 303, head 338 is drawn against the bottom of the opening and the nut is pulled against ledges in the slot 303. Thus, pulling or tightening the nut against the ledges in slot 303 secures portion 300 in place on the back 318 of ball striking portion 316 and prevents portion 300 from sliding along surface 318 in either of the directions indicated by arrow 350 and or arrow 351.

Using the tool (e.g., an Allen wrench) to turn head 338 such that the distal end of the externally threaded leg (that is attached to head 338) turns out of the square nut in T-shaped slot 303 loosens the nut such that when portion 300 is slid along surface 318 in the direction of arrow 350 or 351, the nut slides through slot 303. When portion 300 is in the desired position, the tool (e.g., an Allen wrench) is inserted in opening 339 and is used to turn head 338 and the externally threaded leg attached thereto to compress the nut in slot 303 against ledges formed therein to secure portion 300 in the desired position. A similar arrangement is provided in conjunction with portion 299 to position and secure portion 299 along the back surface 318 of ball striking portion 316.

Portion 300 and the proximate end of shaft 322 can, if desired, be permanently affixed in the position shown in FIG. 32 or remain permanently affixed in some other position on portion 316. The proximate end of shaft 322 can be permanently affixed to portion 316 at a location separate from either portion 300 or portion 299.

Figure 33:
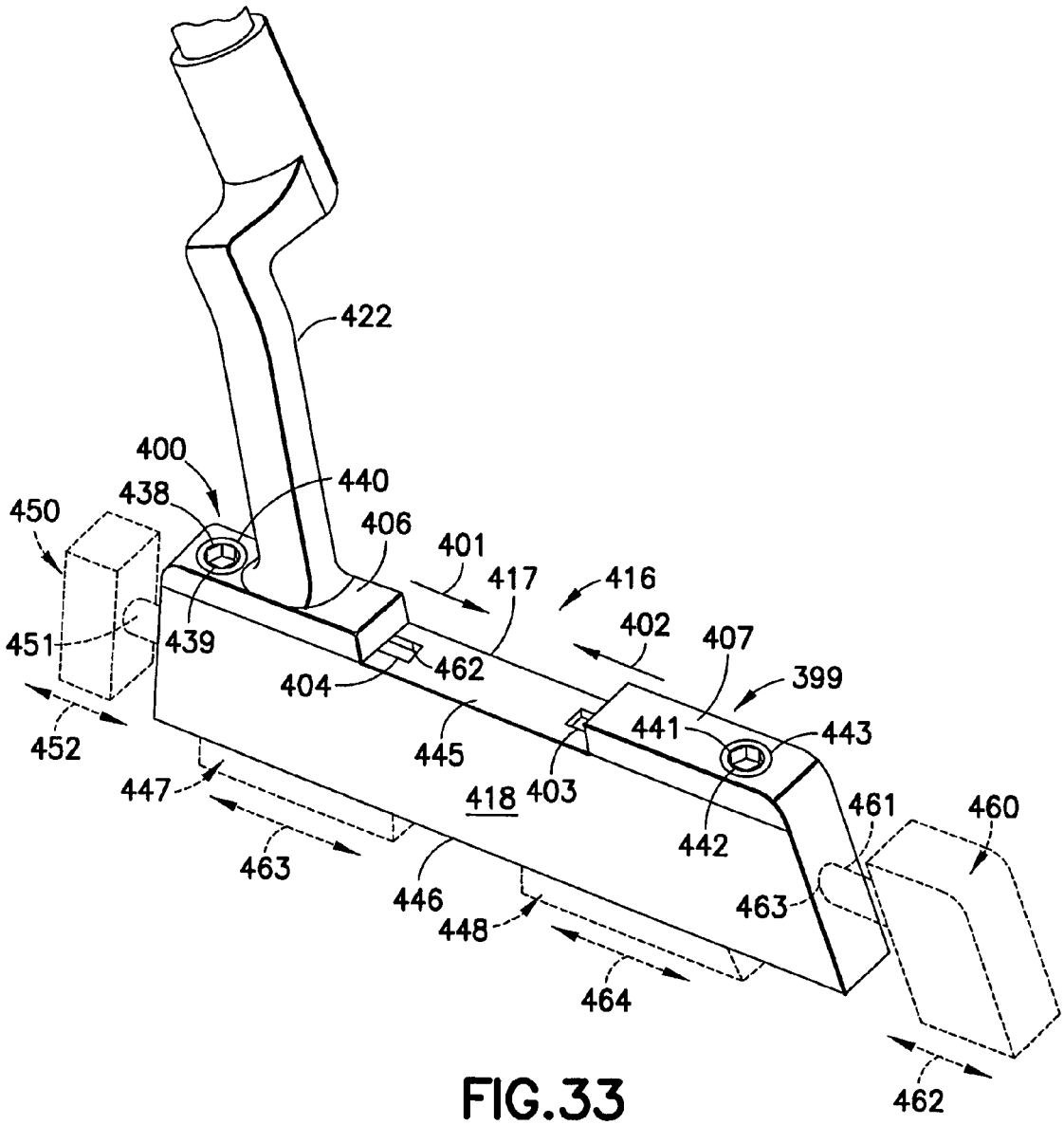
FIG. 33 is a rear perspective view of a golf putter according to another embodiment of the present invention.
Figure 34:
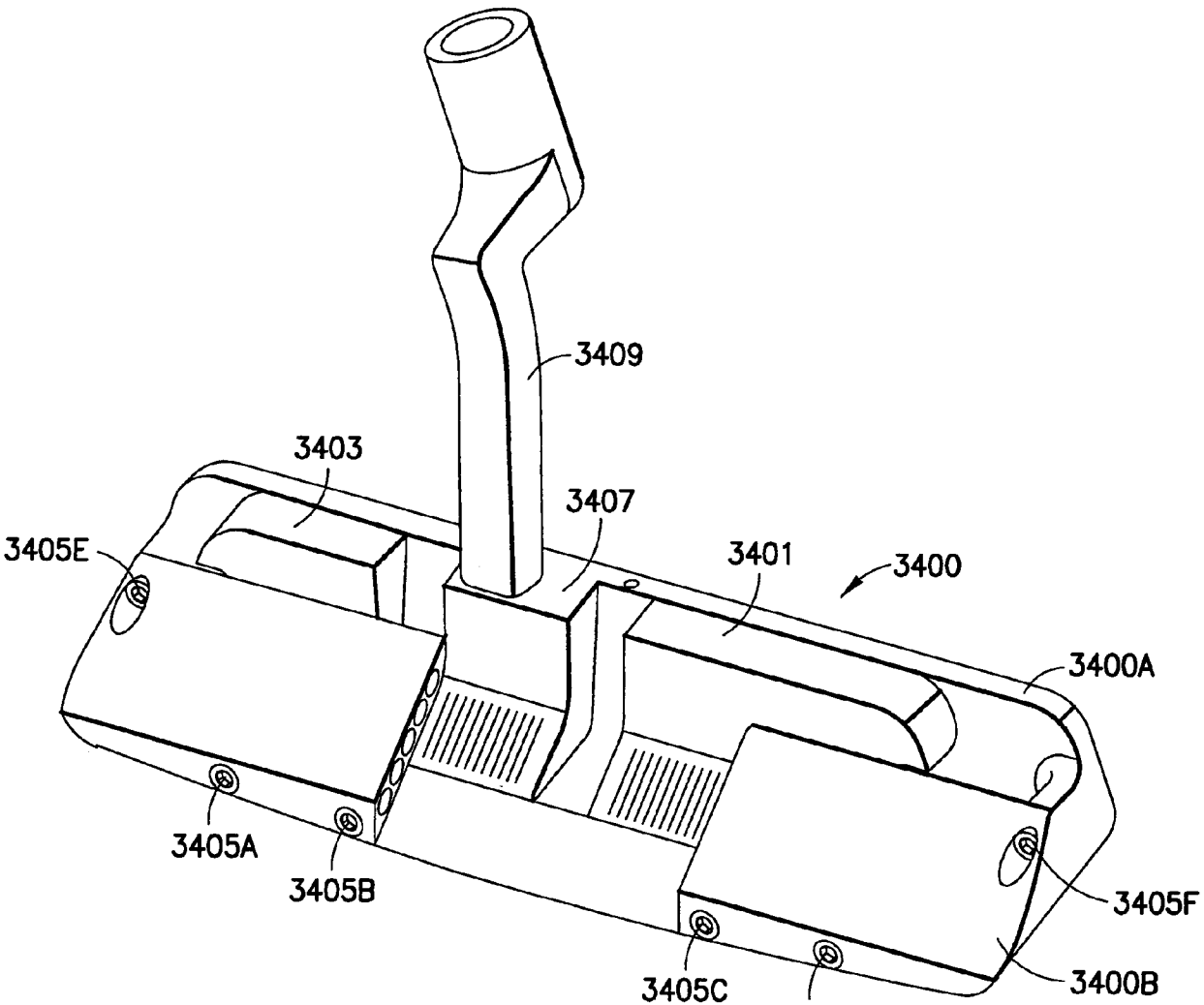
FIGS. 34–37 are views of a golf putter according to another embodiment of the present invention
Figure 35:
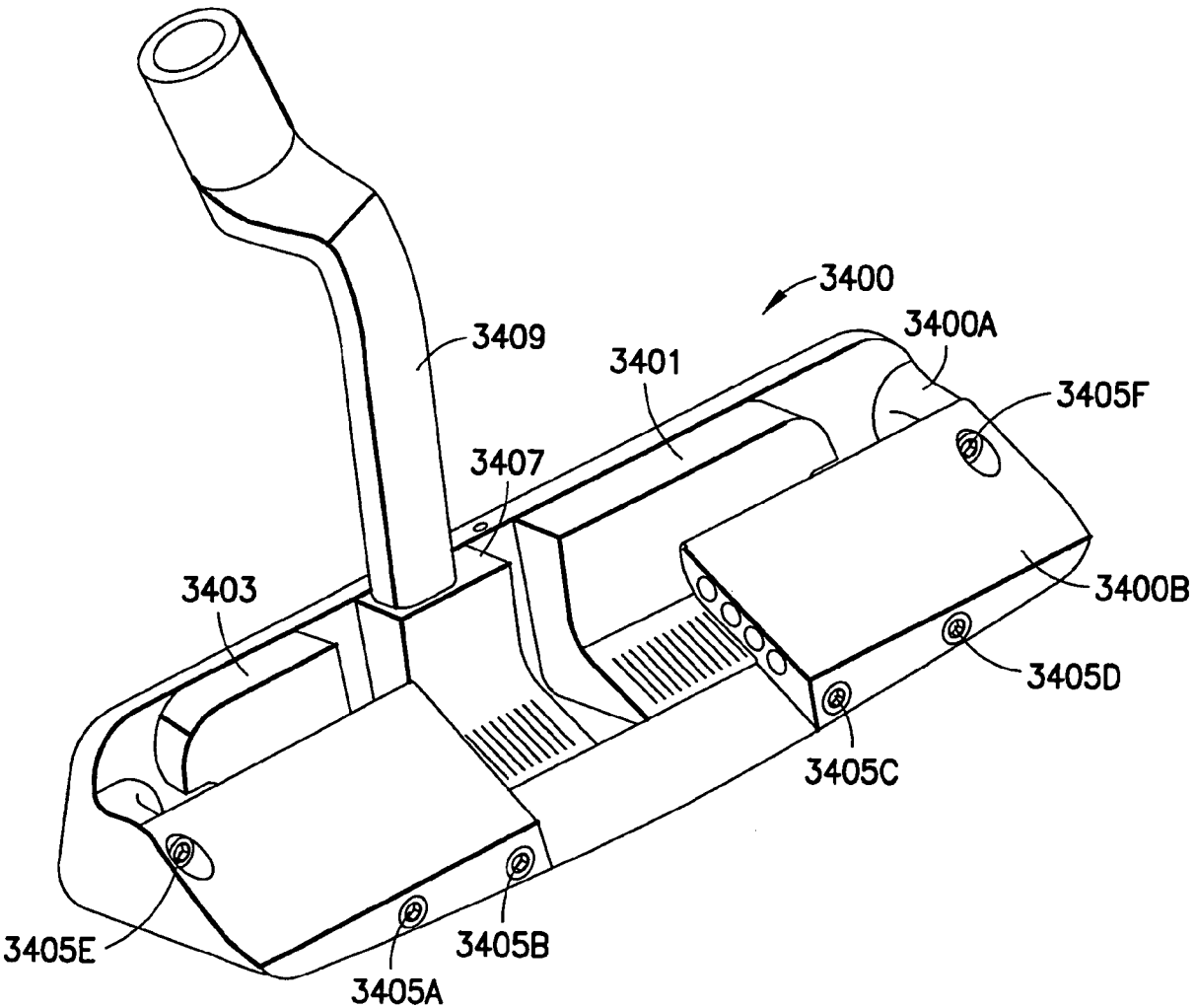
Figure 36:
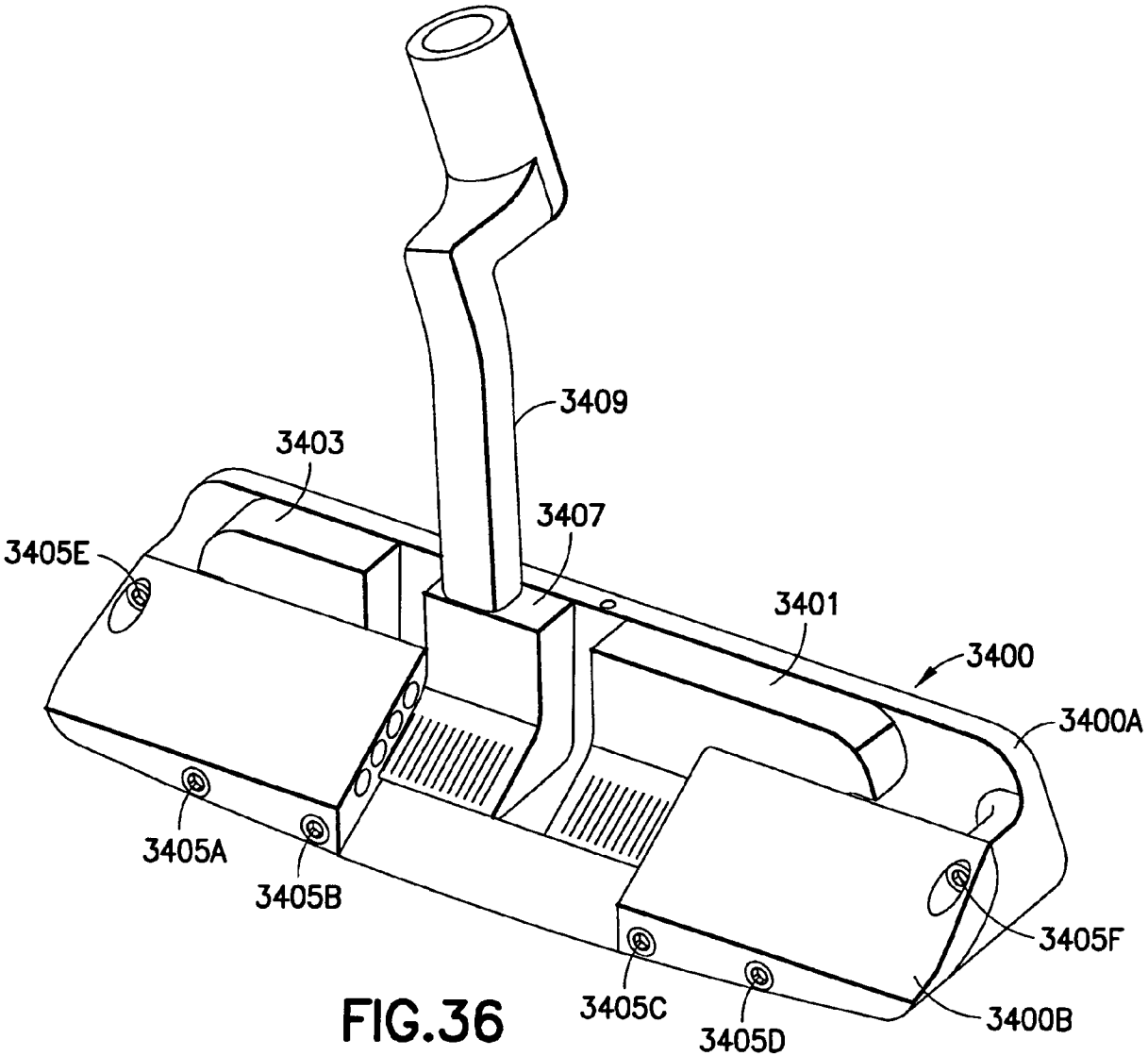
Figure 37:
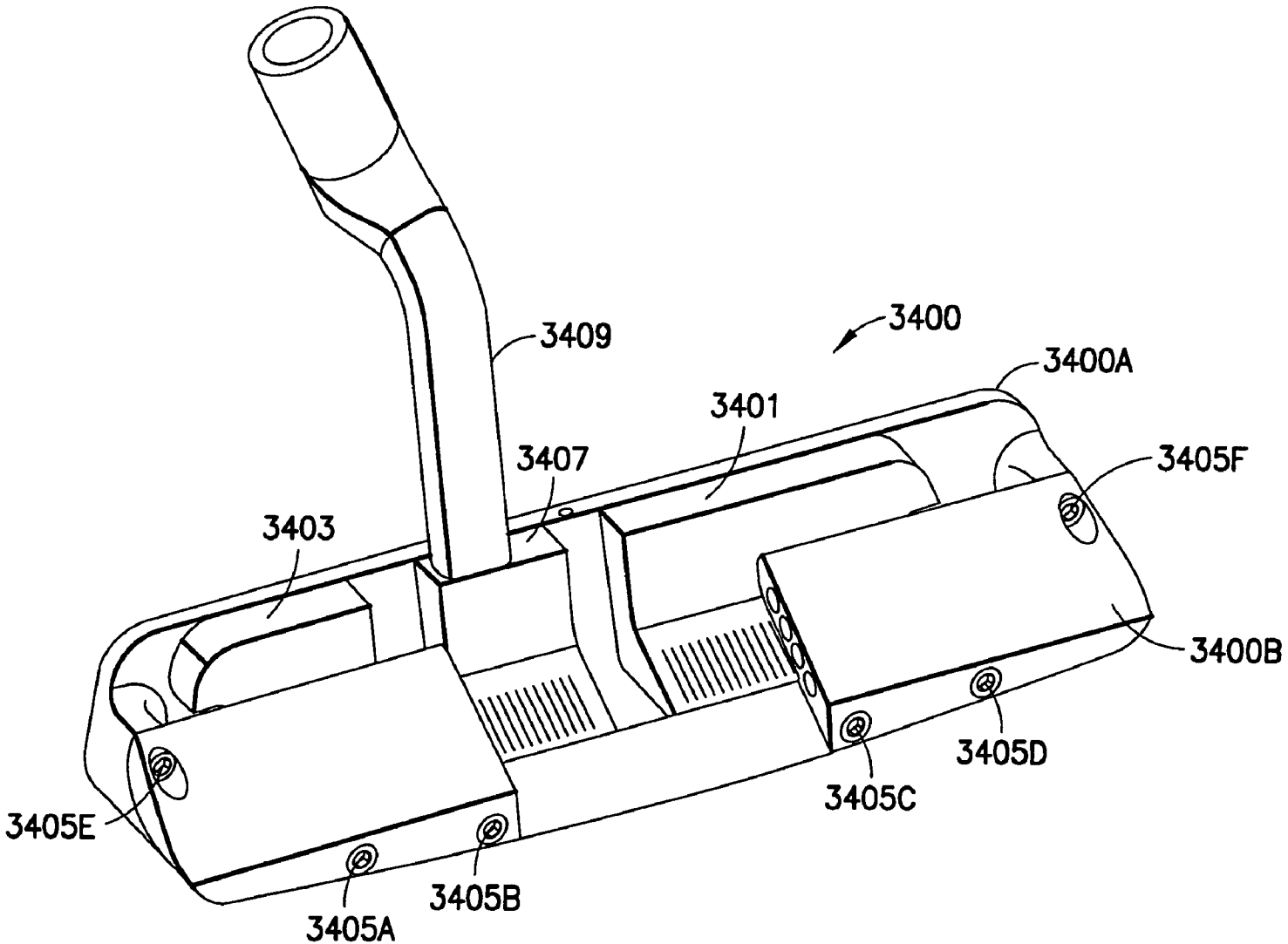

FIG. 33 illustrates another embodiment of the golf putter of the invention. The putter includes a shaft 422 having a distal end (not visible) with a conventional grip or handle and having a proximate end fixedly (or removably, if desired) connected to the top 406 of slidable orthogonal balancing portion 400. Slidable orthogonal balancing portion 399 includes top 407. The shape and dimension of portion 400 is shown as essentially identical to that of portion 399, although this need not be the case.

In FIG. 33, portions 399 and 400 are illustrated in a position in which they each are slid apart to the furthest extent of travel toward the outer ends or portions (i.e., the toe and heel) of ball striking portion 416. The position of portions 399 and 400 in FIG. 32 produces, or nearly produces, a putter head with a toe-weighted balance orientation.

Portions 399 and 400 can be slid from the positions shown in FIG. 33 toward and adjacent one another in the directions indicated by arrows 402 and 401, respectively, in the same manner that portions 299 and 300 may be slid together in FIG. 32, or can be slid in the directions of arrows 401, 402 to intermediate positions along the top 445 of ball striking portion 416.

Any desired means may be utilized to secure a portion 399 or 400 at a desired location on ball striking portion 416. One example system (which example is intended to be illustrative and not restrictive) is partially visible in FIG. 33 and is similar to the securing systems illustrated in FIGS. 30, 31, 32. Ball striking portion 316 includes a T-shaped slot 404 that is formed therein and is similar to T-shaped slot 303. Slot 404 includes ledges similar to ledges 235 and 236 in slot 233 and to comparable ledges formed in slot 303. Slot 404 also includes opening 462 similar to opening 352 in slot 303 and opening 234 in slot 233. Slot 404 is, like slot 303, shaped to slidably receive a square nut (not visible) having a shape equivalent to that of nut 232. The distal end of an externally threaded leg that is equivalent to leg 231 turns into the square nut in the same manner that is illustrated in FIGS. 30 and 31 for leg 231. The proximate end of the externally threaded leg is fixedly attached to the cylindrical head 438. Head 438 nests and is seated in opening 440. The external diameter of head 438 is greater than that of a cylindrically shaped leg opening (not visible) that extends from opening 440 through portion 400 and that receives the externally threaded leg connected to head 438. The cylindrically shaped leg opening extends from opening 440 completely through portion 400. Head 438 remains seated in opening 440, and is larger than and is therefore prevented from moving into the cylindrically shaped leg opening formed in portion 400. Head 438 includes a feature, such as hexagonal opening 439 shaped to receive a tool (e.g., an Allen wrench) such that the tool can be used to turn head 438 and the externally threaded leg attached to head 438 such that the distal end of the externally threaded leg turns into or out of the square nut that is in T-shaped slot 404.

When the distal end of the externally threaded leg attached to head 438 is turned into the square nut in slot 404, head 438 is drawn against the bottom of opening 440 and the nut is pulled against ledges in the slot 404. Thus, pulling or tightening the nut against the ledges in slot 404 secures portion 400 in place on the top of ball striking portion 416 and prevents portion 400 from sliding along the top of portion 416 in either of the directions indicated by arrow 401 and arrow 402.

Using the tool (e.g., an Allen wrench) to turn head 438 such that the distal end of the externally threaded leg attached to head 438 turns out of the square nut in T-shaped slot 404 loosens the nut such that when portion 400 is slid along the top of portion 416 in the direction of arrow 401 or 402, the nut slides through slot 404. When portion 400 is in the desired position on the top 445 of portion 416, the tool (e.g., an Allen wrench) is inserted in opening 439 and is used to turn head 438 and the externally threaded leg fixedly attached thereto to compress the nut in slot 404 against ledges formed therein to secure portion 400 in the desired position. A similar arrangement is provided for positioning and securing portion 399 along the top 445 of ball striking portion 416.

Portion 400 and the proximate end of shaft 422 can, if desired, be permanently affixed in the position shown in FIG. 33 or remain permanently affixed in some other position on portion 416. The proximate end of shaft 422 can be permanently affixed to portion 416 at a location separate from either portion 400 or portion 399.

If desired, at least one adjustable portion 447, 448 can be mounted on the bottom of portion 416 such that the position of portion 447 on the bottom of portion 416 can be adjusted in the direction of arrows 463 and such that the position of portion 448 on the bottom of portion 416 can be adjusted in the direction of arrows 464.

If desired, at least one adjustable portion 450, 460 can be mounted on the toe and/or heel of portion 416 such that the position of portion 450 can be slidably adjusted in the directions indicated by arrows 452 and such that the position of portion 460 can be slidably adjusted in the direction indicated by arrows 462. Portion 450 is mounted on arm 451 that slides into and out of portion 416. Portion 460 is mounted on arm 461 that slides in to and out of cylindrical aperture 463 formed in portion 416.

The putter of FIG. 33 (or of any other FIG.), can be constructed such that slidable portions 399, 400 (or other desired slidable portions) are inset or otherwise housed inside ball striking portion 416. The proximate end of shaft 422 can extend into portion 416 (for example, can extend through a slot or opening formed into portion 416) to be connected to a balancing portion 399, 400 that can be secured at different positions on portion 416 to alter the balance orientation and/or weight distribution of the putter.

Portions 399, 400 or other desired balancing portions need not slide to be moved from one position to the next, but can, for example, move from one position to the next, such as from slot to slot, or can be removably secured or otherwise fastened in one position, and removed from that position to be fastened in another position on portion 416.

Referring now to FIGS. 34–37, views of a golf putter according to another embodiment of the present invention are shown.

More particularly, as seen in these FIGS. 34–37, putter head 3400 is comprised of body section 3400A and cover section 3400B. Body section 3400A and cover section 3400B are held together by screws 3405A–F (cover section 3400B may be for cosmetic purposes; further, cover section 3400B may comprise one section or any number of sections).

Further, slidably mounted to body section 3400A are first balancing portion 3401 and second balancing portion 3403. These first and second balancing portions 3401 and 3403 may be slid to desired positions to act as weights and change the weight distribution of the head 3400 (e.g., to effect a desired face-balanced, toe-weighted or intermediate orientation). The concept describing movement of these sliding members to appropriate positions along body section 3400A to effect such desired orientation has been described in detail above.

Of note, each of first balancing portion 3401 and second balancing portion 3403 may be releasable locked in place via any appropriate mechanism (see, for example, the slot/nut/threaded leg mechanism of FIGS. 30 and 31).

Further, slidably mounted to body section 3400A may be shaft receiving portion 3407 (for receiving and holding the proximate end of shaft 3409).

Of course, shaft receiving portion 3407 may be slid to various desired positions and may interact with the weight of first balancing portion 3401 and second balancing portion 3403 to change the weight distribution of the head 3400 (e.g., to effect a desired face-balanced, toe-weighted or intermediate orientation). Again, the concept describing movement of these sliding members to appropriate positions along body section 3400A to effect such desired orientation has been described in detail above.

In addition, shaft receiving portion 3407 may be releasable locked in place via any appropriate mechanism (see, for example, the slot/nut/threaded leg mechanism of FIGS. 30 and 31).

Moreover, it is noted that shaft receiving portion 3407 may be disposed between first balancing portion 3401 and second balancing portion 3403 (as shown in FIGS. 34–37) or shaft receiving portion 3407 may be disposed either to the left or right of both first balancing portion 3401 and second balancing portion 3403.

In another embodiment of the present invention the golf club may comprise a material selected from the group including, but not limited to: (a) tungsten; (b) aluminum; (c) stainless steel; (d) brass; (e) lead; (f) beryllium; (g) titanium; (h) nickel; (i) platinum; and (j) any combination thereof.

More particularly, the golf club head may comprise any of the above-mentioned materials.

Further, one component (e.g., one balancing portion or weight) may be formed from one or more of the above-mentioned materials and another component (e.g., another balancing portion or weight) may be formed from other one(s) of the above-mentioned materials.

Further still, one component (e.g., one balancing portion or weight) may be formed to have a particular density and/or geometry (internal and/or external geometry) and another component (e.g., another balancing portion or weight) may be formed to have a different density and/or geometry (internal and/or external geometry).

In another embodiment of the present invention one or more of the moveable members (and/or the fixed parts of the head) may have indicia for indicating the position of the movable member (see, e.g., the lines on the moveable members of FIGS. 34–37).

While a number of embodiments of the present invention have been described, it is understood that these embodiments are illustrative only, and not restrictive, and that many modifications may become apparent to those of ordinary skill in the art. For example, the golf club of the present invention can be readily constructed for right-handed and/or left-handed golfers. Further, various movable members may be movable in an essentially infinite or continuous manner (e.g., between two end points) and/or various movable members may be movable in a "stepped" or "detented" manner (e.g., between two end points).

What is claimed is:

1. A golf club comprising:

a head, which head includes at least first and second balancing portions, each slidably mounted to the head;

a shaft, which shaft includes at least a proximate end and a distal end;

a first locking mechanism, which first locking mechanism releasably locks the first balancing portion at each of a plurality of positions to which it is slidable; and a second locking mechanism, which second locking mechanism releasably locks the second balancing portion at each of a plurality of positions to which it is slidable;

wherein the first balancing portion is slidable between at least a first position and a second position independently of the position of the second balancing portion;

wherein the second balancing portion is slidable between at least a first position and a second position independently of the position of the first balancing portion;

wherein the shaft is attached at the proximate end to at least one of the first and second balancing portions such that the shaft is slidable along with the balancing portion to which the shaft is attached;

wherein the first locking mechanism includes a first threaded fastener which is substantially fixed relative to the head and which interfaces with a first threaded nut disposed within a first groove associated with the first balancing portion; and wherein the second locking mechanism includes a second threaded fastener which is substantially fixed relative to the head and which interfaces with a second threaded nut disposed within a second groove associated with the second balancing portion;

further comprising at least one weight which is moveable along an axis which is generally orthogonal to a ball striking face of the head.

2. The golf club of claim 1, comprising two weights, each of which is moveable along an axis which is generally orthogonal to a ball striking face of the head.

3. The golf club of claim 2, wherein each weight is slidable along a respective rod.

4. A golf club comprising:

a head, which head includes at least first and second balancing portions, each slidably mounted to the head;

a shaft, which shaft includes at least a proximate end and a distal end;

a first locking mechanism, which first locking mechanism releasably locks the first balancing portion at each of a plurality of positions to which it is slidable; and a second locking mechanism, which second locking mechanism releasably locks the second balancing portion at each of a plurality of positions to which it is slidable;

wherein the first balancing portion is slidable between at least a first position and a second position independently of the position of the second balancing portion;

wherein the second balancing portion is slidable between at least a first position and a second position independently of the position of the first balancing portion;

wherein the shaft is attached at the proximate end to at least one of the first and second balancing portions such that the shaft is slidable along with the balancing portion to which the shaft is attached;

wherein the first locking mechanism includes a first threaded fastener which is substantially fixed relative to the head and which interfaces with a first threaded nut disposed within a first groove associated with the first balancing portion; and wherein the second locking mechanism includes a second threaded fastener which is substantially fixed relative to the head and which interfaces with a second threaded nut disposed within a second groove associated with the second balancing portion;

wherein at least one of the first balancing portion and the second balancing portion includes at least one indicia, wherein the indicia indicates the position of the respective balancing portion relative to the head.

5. A golf club comprising:

a head, which head includes at least first and second balancing portions, each slidably mounted to the head;

a shaft, which shaft includes at least a proximate end and a distal end;

a first locking mechanism, which first locking mechanism releasably locks the first balancing portion at each of a plurality of positions to which it is slidable; and a second locking mechanism, which second locking mechanism releasably locks the second balancing portion at each of a plurality of positions to which it is slidable;

wherein the first balancing portion is slidable between at least a first position and a second position independently of the position of the second balancing portion;

wherein the second balancing portion is slidable between at least a first position and a second position independently of the position of the first balancing portion;

wherein the shaft is attached at the proximate end to at least one of the first and second balancing portions such that the shaft is slidable along with the balancing portion to which the shaft is attached;

wherein the first locking mechanism includes a first threaded fastener which is substantially fixed relative to the head and which interfaces with a first threaded nut disposed within a first groove associated with the first balancing portion; and wherein the second locking mechanism includes a second threaded fastener which is substantially fixed relative to the head and which interfaces with a second threaded nut disposed within a second groove associated with the second balancing portion;

wherein the head further comprises an articulated ball striking face.

6. The golf club of claim 5, wherein the articulated ball striking face is pivotally mounted to rotate around at least one axis.

* * * * *